US008441409B2

(12) United States Patent
Tatarnikov et al.

(10) Patent No.: US 8,441,409 B2
(45) Date of Patent: May 14, 2013

(54) BROADBAND CONVEX GROUND PLANES FOR MULTIPATH REJECTION

(75) Inventors: Dmitry Tatarnikov, Moscow (RU); Andrey Astakhov, Moscow (RU); Anton Stepanenko, Dedovsk (RU)

(73) Assignee: Topcon GPS, LLC, Oakland, NJ (US)

( * ) Notice: Subject to any disclaimer, the term of this patent is extended or adjusted under 35 U.S.C. 154(b) by 334 days.

(21) Appl. No.: 12/797,035

(22) Filed: Jun. 9, 2010

(65) Prior Publication Data

US 2011/0012808 A1 Jan. 20, 2011

Related U.S. Application Data

(60) Provisional application No. 61/225,367, filed on Jul. 14, 2009.

(51) Int. Cl.
*H01Q 1/48* (2006.01)

(52) U.S. Cl.
USPC ..... 343/848; 343/846; 343/700 MS

(58) Field of Classification Search ..... 343/700 MS, 343/846, 848, 824
See application file for complete search history.

(56) References Cited

U.S. PATENT DOCUMENTS

| | | | | |
|---|---|---|---|---|
| 6,278,407 | B1 | 8/2001 | Ashjaee | |
| 6,411,261 | B1 | 6/2002 | Lilly | |
| 7,075,485 | B2 * | 7/2006 | Song et al. | 343/700 MS |
| 7,532,170 | B1 | 5/2009 | Lee et al. | |
| 2003/0010529 | A1 | 1/2003 | Sievenpiper et al. | |

FOREIGN PATENT DOCUMENTS

| | | |
|---|---|---|
| DE | 2029412 | 12/1971 |
| WO | WO 9806147 | 2/1998 |

OTHER PUBLICATIONS

Liu, T. et al., "Effect of Curvature on Reflection Phase Characteristics of Electromagnetic Band-Gap Structures", Global Symposium on Millimeter Waves Proceedings, GMSS, Apr. 21, 2008.

Tatarnikov, D. "Enhanced Bandwidth Patch Antenna with Artificial Dielectric Substrates for High Precision Satellite Positioning", IEEE International Workshop on Antenna Technology, IWAT, Mar. 4, 2009.

International Search Report corresponding to PCT/IB2010/001720 filed Jul. 8, 2010 (5 pages).

Written Opinion of the International Searching Authority corresponding to PCT/IB2010/001720 filed Jul. 8, 2010 (9 pages).

J. Tranquilla, "Analysis of a Choke Ring Groundplane for Multipath Control in Global Positioning System (GPS) Applications", IEEE Transactions on antennas and Propagation, vol. 42, No. 7, Jul. 1994, pp. 905-911.

* cited by examiner

*Primary Examiner* — Hoang V Nguyen
(74) *Attorney, Agent, or Firm* — Wolff & Samson PC

(57) ABSTRACT

A ground plane for reducing multipath reception comprises a convex conducting surface and an array of conducting elements disposed on at least a portion of the convex conducting surface. Embodiments of the convex conducting surface include a portion of a sphere and a sphere. Each conducting element comprises an elongated body structure having a transverse dimension and a length, wherein the transverse dimension is substantially less than the length. The cross-section of the elongated body structure can have various user-specified shapes. Each conducting element can further comprise a tip structure. The azimuth spacings, lengths, and surface densities of the conducting elements can be functions of meridian angle. An antenna can be mounted directly on the conducting convex surface or on a conducting or dielectric support structure mounted on the conducting convex surface. System components, such as a navigation receiver, can be mounted inside the conducting convex surface.

22 Claims, 26 Drawing Sheets

VIEW A

VIEW B

VIEW C

FIG. 18A
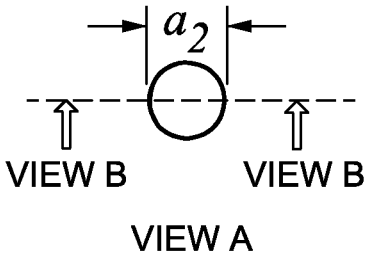
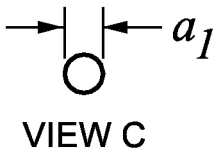
FIG. 18C
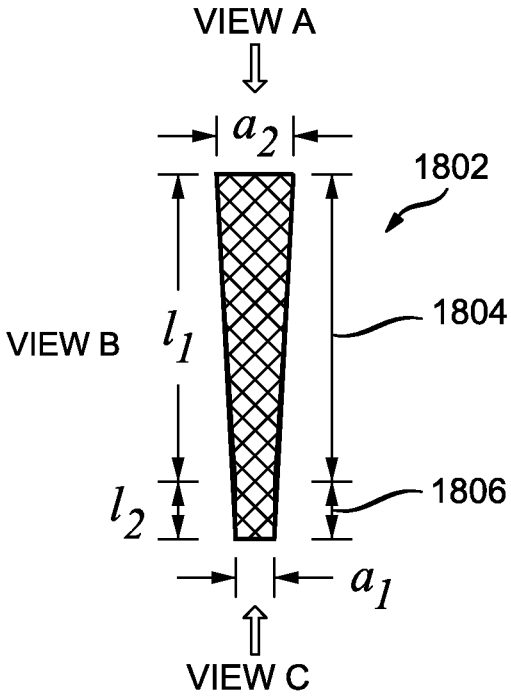
FIG. 18B
FIG. 19A
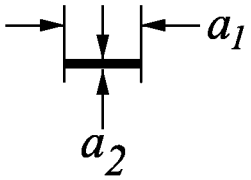
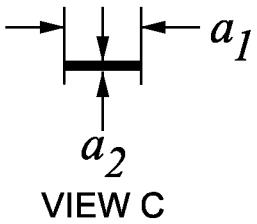
FIG. 19C
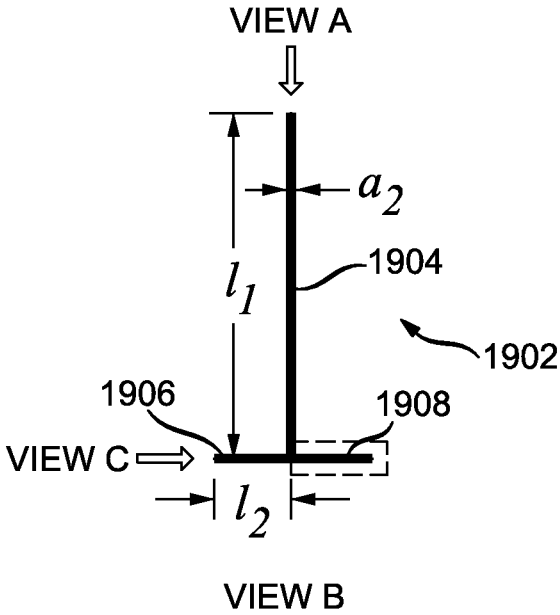
FIG. 19B FIG. 21A
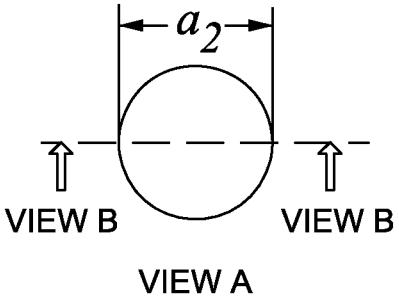
FIG. 21B
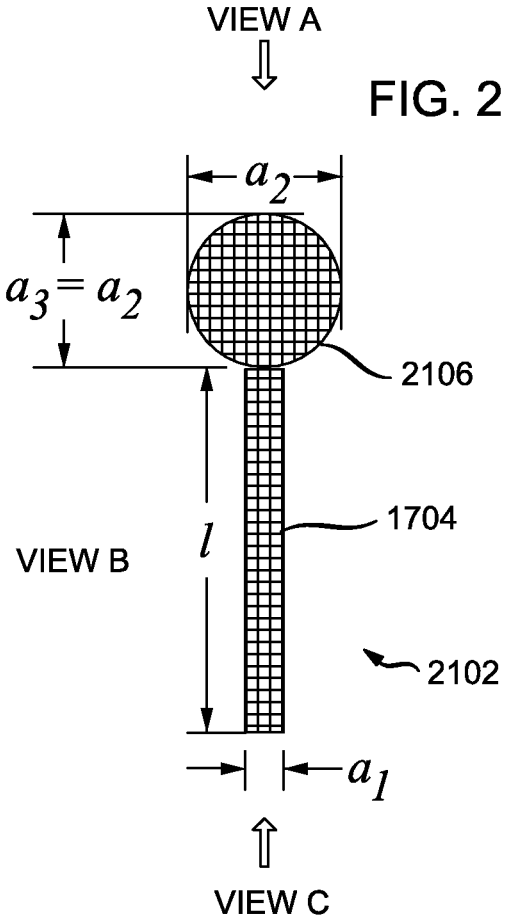
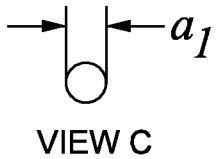
FIG. 21C FIG. 22A
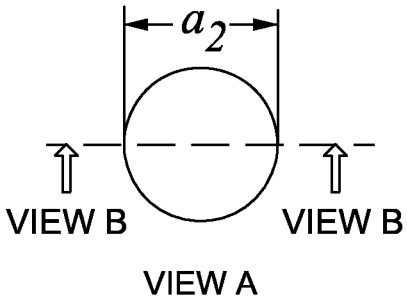
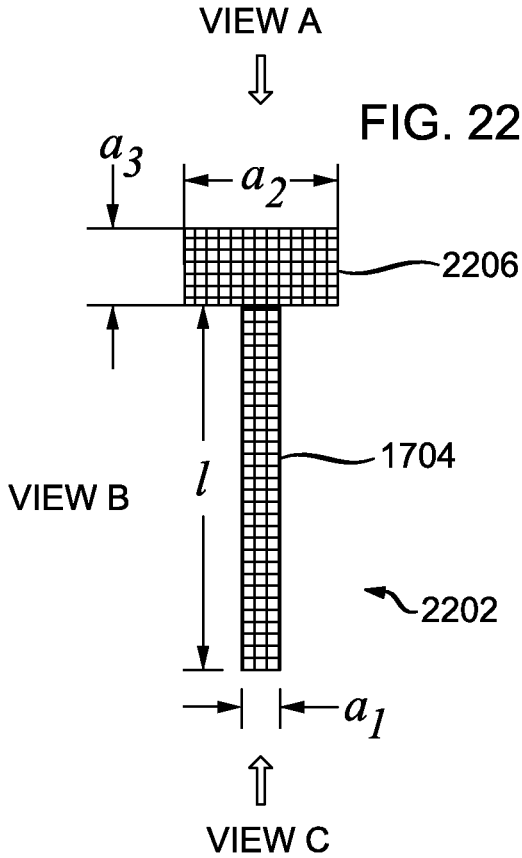
FIG. 22B
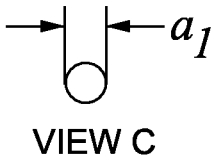
FIG. 22C FIG. 23A
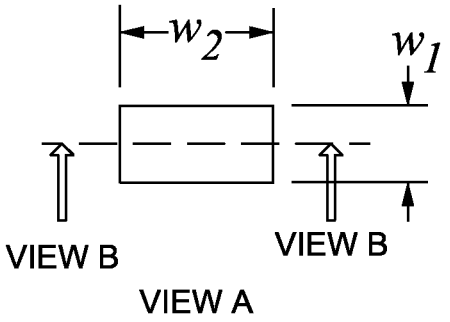
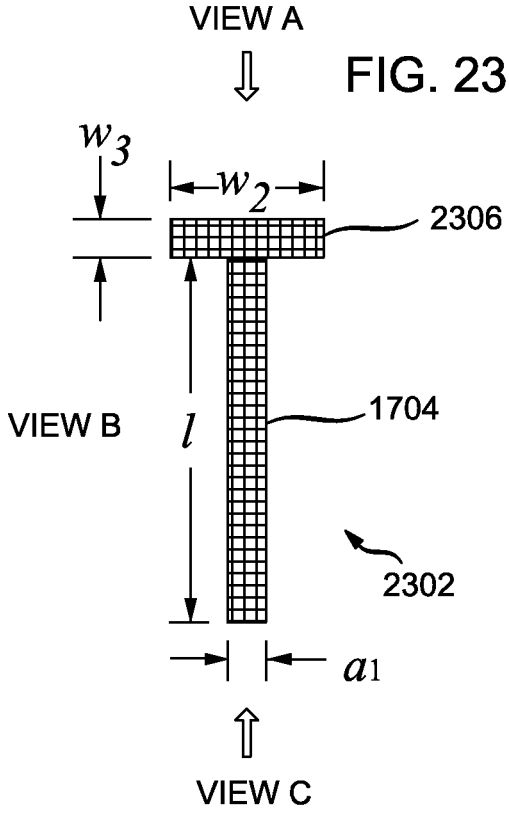
FIG. 23B
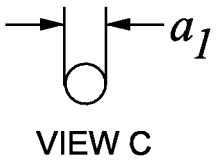
FIG. 23C FIG. 24A
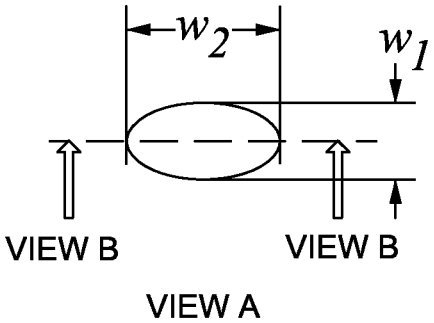
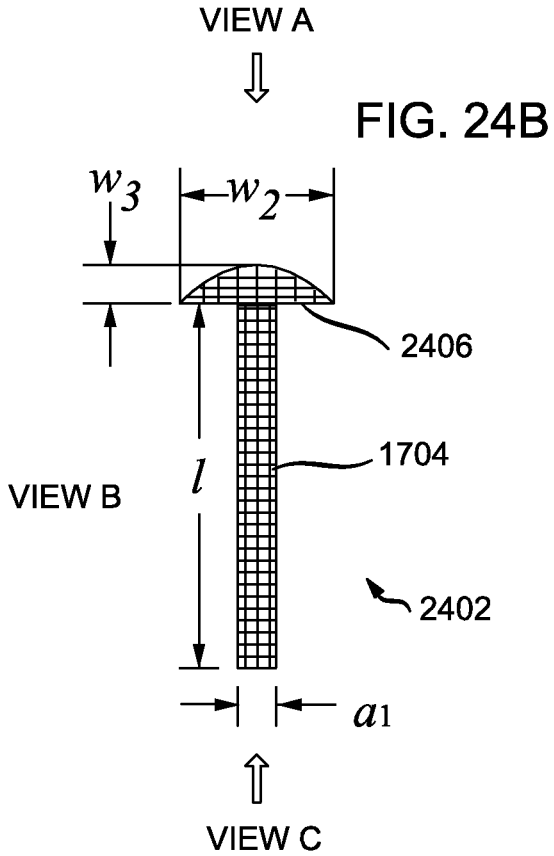
FIG. 24B
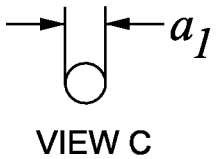
FIG. 24C

BROADBAND CONVEX GROUND PLANES FOR MULTIPATH REJECTION

This application claims the benefit of U.S. Provisional Application No. 61/225,367 filed Jul. 14, 2009, which is incorporated herein by reference.

BACKGROUND OF THE INVENTION

The present invention relates generally to antennas, and more particularly to broadband convex ground planes for multipath rejection.

Multipath reception is a major source of positioning errors in global navigation satellite systems (GNSSs). Multipath reception refers to the reception by a navigation receiver of signal replicas caused by reflections from the receiver environment. The signals received by the antenna in the receiver are a combination of the line-of-sight ("true") signal and multipath signals reflected from the underlying ground surface and surrounding objects and obstacles. Multipath reception adversely affects the operation of the entire navigation system. To mitigate multipath reception, the receiving antenna is commonly mounted onto a ground plane. Various types of ground planes are used in practice; for example, flat metal ground planes and choke rings.

A flat metal ground plane is advantageous because of its simple design, but it requires a relatively large size (up to a few wavelengths of the received signal) to efficiently mitigate reflected signals. The relatively large size limits the usage of flat ground planes, since many applications call for compact receivers. At smaller dimensions, a choke ring mitigates multipath reception significantly better than a flat ground plane. Basics of the choke ring design are presented, for example, in J. M. Tranquilla, J. P. Carr, and H. M. Al-Rizzo, "Analysis of a Choke Ring Groundplane for Multipath Control in Global Positioning System (GPS) Applications", Proc. IEEE AP, vol. AP-42, No. 7, pp. 905-911, July 1994. A choke ring is designed with a number of concentric grooves machined in a flat metal body. A primary application for choke-ring antennas is to provide good protection against multipath signals reflected from underlying terrain.

Common choke-ring antennas, however, have a number of disadvantages. A choke-ring ground plane contributes to undesirable narrowing of the antenna directivity pattern. Narrowing the antenna directivity pattern results in poorer tracking capability for satellites with low elevations. Also, the performance of a choke-ring structure is frequency-dependent. In a choke ring, the depth of the grooves should be slightly greater than, but still close to, a quarter of the carrier wavelength. Because new GNSS signal bands (such as GPS L5, GLONASS L3, and GALILEO E6 and E5) are being introduced, the overall frequency spectrum of GNSS signals is increasing significantly; consequently, traditional choke ring capabilities are becoming limited.

U.S. Pat. No. 6,278,407, for example, discusses a choke-ring ground plane with a number of grooves in which there are apertures with micropatch filters. The filters are adjusted such that the apertures pass low-frequency band signals (for example, GPS/GLONASS L2) and reflect high-frequency band signals (for example, GPS/GLONASS L1). The position of the apertures is selected such that it provides the best multipath rejection within the L1 band. This structure is a dual-frequency unit and does not provide good multipath mitigation within the entire GNSS frequency range. As mentioned above, the directivity pattern is also narrowed.

What is needed is a ground plane design for an antenna system with wide directivity pattern, high multipath rejection, and a broad frequency range. Efficient usage of the space inside the antenna system to accommodate various components such as a navigation receiver is advantageous.

BRIEF SUMMARY OF THE INVENTION

A ground plane for reducing multipath reception comprises a convex conducting surface and an array of conducting elements disposed on at least a portion of the convex conducting surface. Embodiments of the convex conducting surface include a portion of a sphere and a sphere. Each conducting element comprises an elongated body structure having a transverse dimension and a length, wherein the transverse dimension is less than the length. The cross-section of the elongated body structure can have various user-specified shapes, including a circle, an ellipse, a square, a rectangle, and a trapezoid. Each conducting element can further comprise a tip structure. Embodiments of tip structures include a portion of a sphere, a sphere, a portion of an ellipsoid, an ellipsoid, an elbow, and a tee. In some embodiments, the azimuth spacings, lengths, and surface densities of the conducting elements are functions of meridian angle.

These and other advantages of the invention will be apparent to those of ordinary skill in the art by reference to the following detailed description and the accompanying drawings.

BRIEF DESCRIPTION OF THE DRAWINGS

FIG. 18A-FIG. 18C show an embodiment of a conducting element;

FIG. 19A-FIG. 19C show an embodiment of a conducting element;

FIG. 21A-FIG. 21C show an embodiment of a conducting element;

FIG. 22A-FIG. 22C show an embodiment of a conducting element;

FIG. 23A-FIG. 23C show an embodiment of a conducting element;

FIG. 24A-FIG. 24C show an embodiment of a conducting element;

DETAILED DESCRIPTION

Figure 1A:
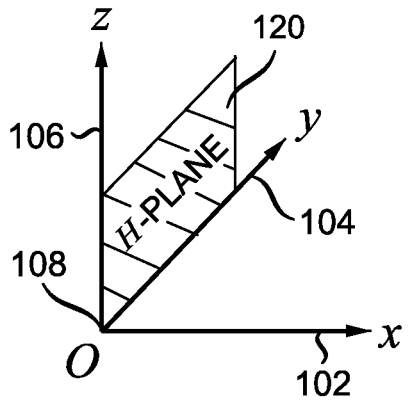
FIG. 1A-FIG. 1C show a reference coordinate system.
Figure 1B:
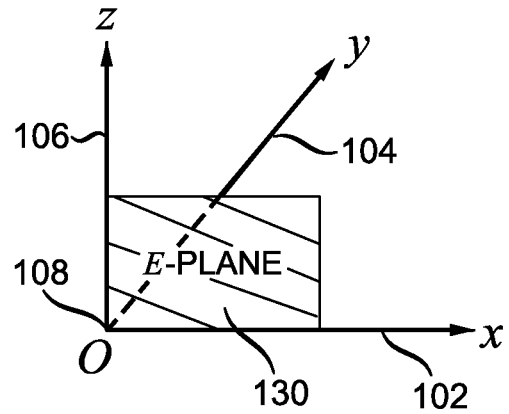

Since the polarization of the multipath signals are correlated with the polarization of the line-of-sight signals (as described in more detail below), multipath rejection capabilities of a ground plane can be characterized in terms of linear-polarized signals instead of circular-polarized signals. FIG. 1A and FIG. 1B show perspective views of a Cartesian coordinate system defined by the x-axis 102, y-axis 104, z-axis 106, and origin O 108. As shown in FIG. 1A, the magnetic field H-plane 120 lies in the y-z plane; as shown in FIG. 1B, the electric field E-plane 130 lies in the x-z plane. In the discussion below, modelling is performed with respect to the E-plane. Modelling with respect to the E-plane presents a worst-case scenario, since the multipath rejection capabilities of the antenna with respect to the H-plane are better than or equal to the multipath rejection capabilities of the antenna with respect to the E-plane.

Figure 1C:
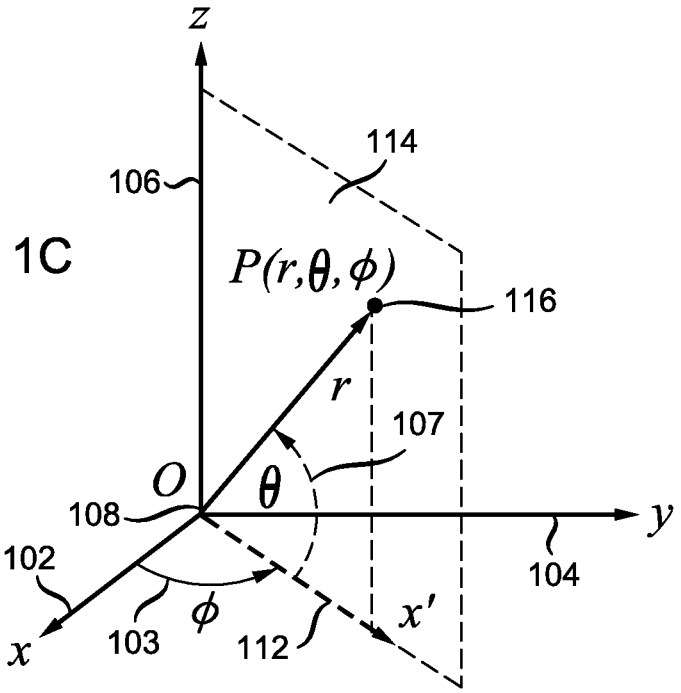

Geometric configurations are also described with respect to a spherical coordinate system, as shown in the perspective view of FIG. 1C. The spherical coordinates of a point P 116 are given by $(r,\theta,\phi)$, where r is the radius measured from the origin O 108. Herein a point P has corresponding values of $(r,\theta,\phi)$. The x-y plane is referred to as the azimuth plane; and $\phi$ 103, measured from the x-axis 102, is referred to as the azimuth angle. A plane defined by $\phi$=constant and intersecting the z-axis 106 is referred to as a meridian plane. A general meridian plane 114, defined by the z-axis 106 and the x'-axis 112, is shown in FIG. 1C. The x-z plane and y-z plane are specific instances of meridian planes. In some conventions, the angle $\theta$, referred to as the meridian angle, is measured from the z-axis 106. In other conventions, as used herein, the angle $\theta$ is measured from the x'-axis 112 (denoted $\theta$ 107) and is also referred to as the elevation angle.

Figure 2:
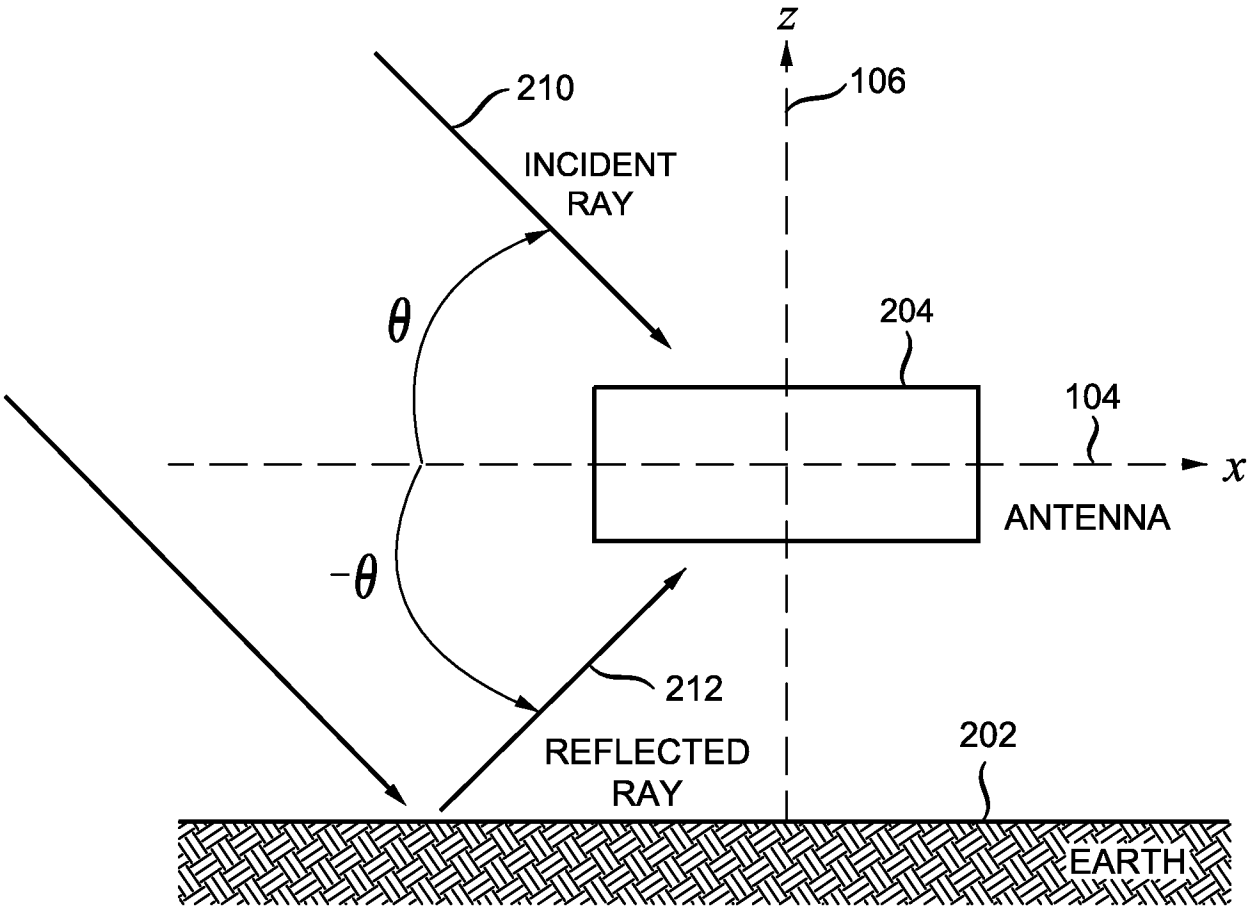
FIG. 2 shows the geometry of incident and reflected rays.

FIG. 2 shows a schematic of an antenna 204 positioned above the Earth 202. The antenna 204, for example, can be mounted on a surveyor's tripod (not shown) for geodetic applications; it can also be held by a user or mounted on a vehicle. The plane of the figure is the E-plane (x-z plane). The +y direction points into the plane of the figure. In an open-air environment, the +z (up) direction (also referred to as the zenith) points towards the sky, and the −z (down) direction points towards the Earth. Herein, the term Earth includes both land and water environments. To avoid confusion with "electrical" ground (as used in reference to a ground plane), "geographical" ground (as used in reference to land) is not used herein.

In FIG. 2, electromagnetic waves are represented as rays, incident upon the antenna 204 at an incident angle $\theta$ with respect to the x-axis. The horizon corresponds to $\theta$=0 deg. Rays incident from the open sky, such as ray 210 and ray 212, have positive values of incident angle. Rays reflected from the Earth 202, such as ray 214, have negative values of incident angle. Herein, the region of space with positive values of incident angle is referred to as the direct signal region and is also referred to as the forward (or top) hemisphere. Herein, the region of space with negative values of incident angle is referred to as the multipath signal region and is also referred to as the backward (or bottom) hemisphere.

Incident ray 210 impinges directly on antenna 204. Incident ray 212 impinges on Earth 202. Reflected ray 214 results from reflection of incident ray 212 off Earth 202. Over a wide range of incident angles, reflection results in flipping the direction of polarization. If incident ray 212 has right-hand circular polarization (RHCP), then reflected ray 214 has mainly left-hand circular polarization (LHCP). Consequently, antenna 204 receives a RHCP signal from above the horizon and receives mainly a LHCP signal from below the horizon. Therefore, antenna 204 is well-matched with the reflected signal by means of polarization.

To numerically characterize the capability of an antenna to mitigate the reflected signal, the following ratio is commonly used:

$$DU(\theta) = \frac{F(-\theta)}{F(\theta)}. \tag{E1}$$

The parameter DU($\theta$) (down/up ratio) is equal to the ratio of the antenna directivity pattern level F(−$\theta$) in the backward hemisphere to the antenna pattern level F($\theta$) in the forward hemisphere at the mirror angle, where F represents a voltage level. Expressed in dB, the ratio is:

$$DU(\theta(\text{dB})=20\log DU(\theta). \tag{E2}$$

Figure 3A:
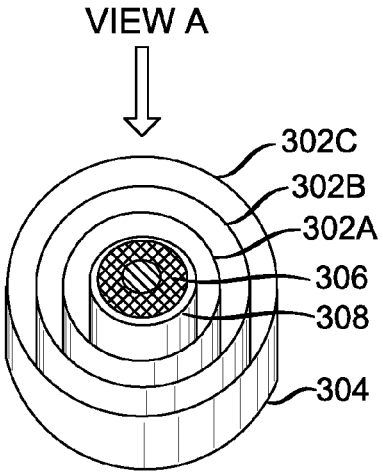
FIG. 3A PRIOR ART
FIG. 3A-FIG. 3C show the geometry of a choke ring.
Figure 3B:
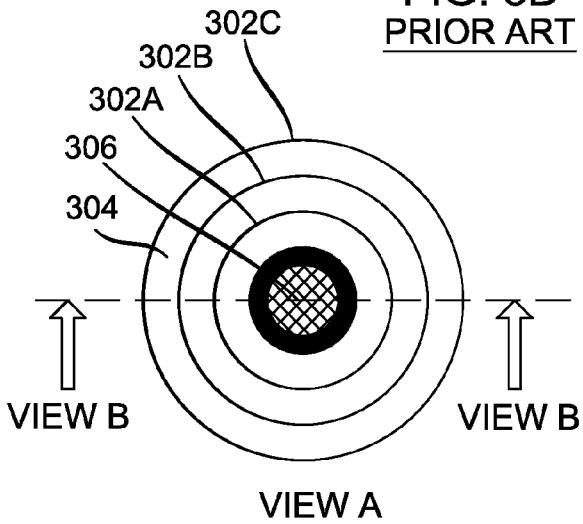
FIG. 3B PRIOR ART
Figure 3C:
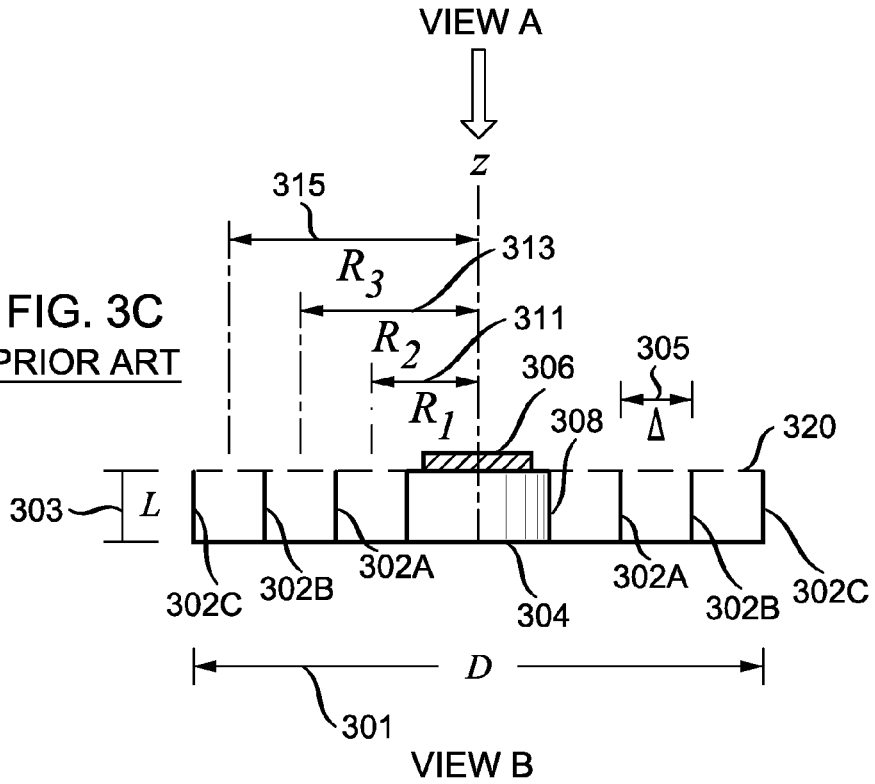
FIG. 3C PRIOR ART

FIG. 3A-3C show an example of a commonly used prior-art choke ring. FIG. 3A is a perspective view; FIG. 3B is a top view; and FIG. 3C is a cross-sectional view. Note that the figures are not to scale. The choke ring includes a set of vertical metal cylindrical rings. In the example shown in FIG. 3A-FIG. 3C, three rings (ring 302A, ring 302B, and ring 302C) are disposed on a flat metal disc 304. As shown in FIG. 3C, the diameter 301 of the flat metal disc 304 is D, and the length (height) 303 of ring 302A, ring 302B, and ring 302C is L. In general, there can be one or more rings. Each ring is galvanically (electrically) connected to the disc along the whole perimeter of the ring. A receiving antenna 306 is mounted on a support 308 in the center of the choke ring.

Note that the structure shown in FIG. 3A-FIG. 3C can be viewed equivalently as a flat metal plate in which a series of concentric grooves are machined. The rings correspond to walls of grooves, and a groove corresponds to the space between two consecutive rings. The depth of a groove is equal to the height L 303. The frequency performance of the choke ring is analyzed as follows. The choke ring structure is known to comprise an "impedance surface"; see, for example, R. E.

Collin, "Field Theory of Guided Waves", Wiley-IEEE Press, 1990. Here, the term "impedance" refers to a certain relationship between the strength of electric and magnetic fields at the surface. The choke ring has an impedance relationship at the top of the grooves, shown as impedance surface 320 in FIG. 3C. For the choke ring, the impedance surface is flat.

Figure 4A:
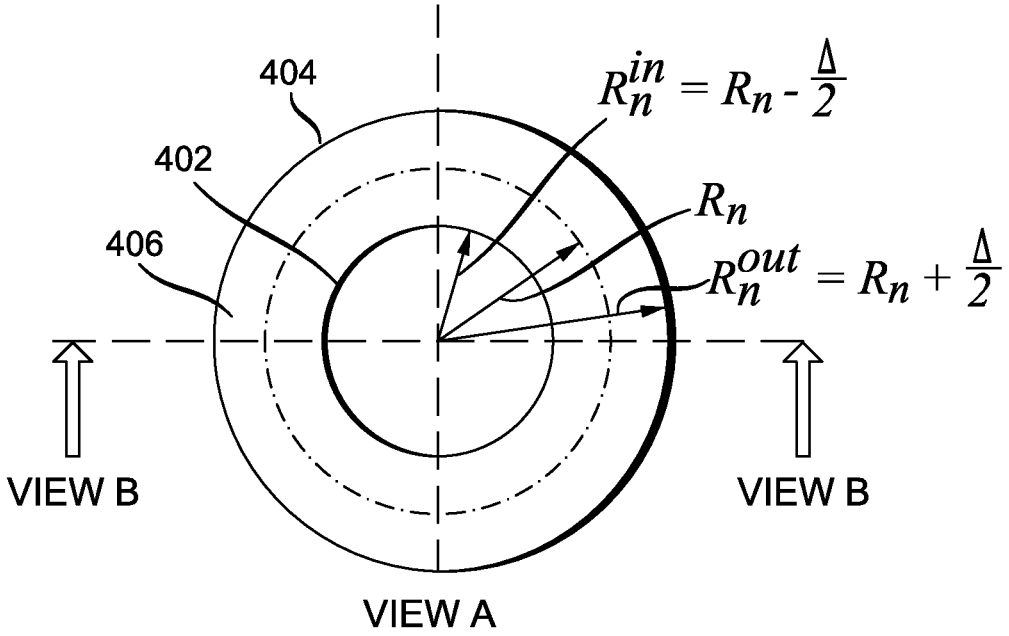
FIG. 4A and FIG. 4B show the geometry of a single groove.
Figure 4B:
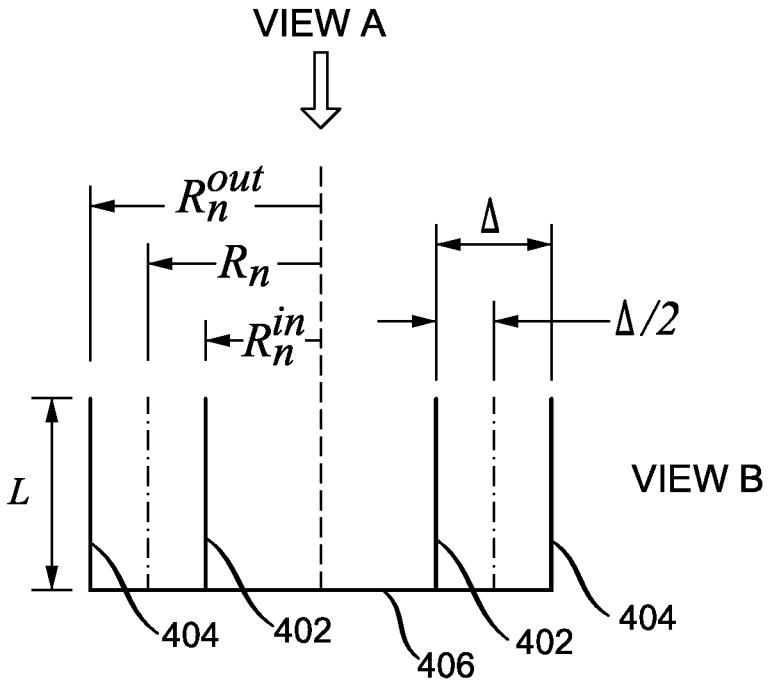

The frequency response of one groove is first analyzed. FIG. 4A and FIG. 4B show the geometry of a groove delimited by groove wall 402, groove wall 404, and base plate 406. The height of groove wall 402 and groove wall 404 is L. The groove can be viewed as a section of a coaxial waveguide shorted at the bottom end and open at the top end. The groove walls have inner and outer radii of $$R_n^{in} = R_n - \frac{\Delta}{2} \text{ and } R_n^{out} = R_n + \frac{\Delta}{2},$$

respectively. Here $R_n$ stands for the radius midway between the inner radius and the outer radius, Δ is the distance between the groove walls, and n=1, 2, . . . , N is an index that enumerates the number of the grooves. The total number of grooves is typically N=3-5.

According to the theory of waveguides, coaxial waveguides can be characterized by a set of eigenwaves (modes). Each mode has its characteristic eigennumber $\chi_m$, with index m=1, 2, . . . , ∞ enumerating the modes within the set. The inequalities $0 \leqq \chi_1 < \chi_2 < \ldots < \chi_m$ hold. Formulas to calculate $\chi_m$ for given radii of the waveguide are given, for example, in P. C. Magnusson, G. C. Alexander, V. K. Tripathi, A. Weisshaar "Transmission Lines and Wave Propagation," CRC Press LLC, 2001. Modes with $$\chi_m < \frac{2\pi}{\lambda}$$

can propagate. Here λ stands for the free-space wavelength. Modes with $$\chi_m > \frac{2\pi}{\lambda}$$

are evanescent. Each propagating mode has its wavelength $\lambda_m$ inside the waveguide, where $$\lambda_m = 2\pi/\Gamma_m,$$

$$\Gamma_m = \sqrt{k^2 - \chi_m^2}, \tag{E3}$$

and $k=2\pi/\lambda$.

For GNSS applications, to analyze the field properties in grooves in a choke ring, a right-hand circular-polarization (RHCP) signal can be used. Such a signal has an azimuthal dependence of the form of $e^{-i\Phi}$. Here ϕ stands for the azimuthal angle around the groove, and i is the imaginary unit. Typically $R_n$ falls within the range of (0.1-1.0)λ, and Δ≈0.1λ. Under these conditions, only one propagating mode is possible: the so-called $TE_{11}$ mode. This mode is mostly responsible for the ground plane performance. The eigennumber for the $TE_{11}$ mode of the n-th groove is denoted as $\chi_{TE_{11}n}$, with $$\Gamma_n = \sqrt{k^2 - \chi_{TE_{11}n}^2} = \frac{2\pi}{\lambda_{TE_{11}n}}, \tag{E4}$$

where $\lambda_{TE_{11}n}$ is the wavelength of the mode for the n-th groove. The open-end impedance $Z_n$ (with admittance $Y_n=1/Z_n$) of the n-th groove with depth L is given by:

$$Z_n = \frac{1}{Y_n} = iW\frac{k}{\Gamma_n}\tan(\Gamma_n L), \tag{E5}$$

where W=120π ohm is the free-space impedance. The groove depth is chosen such that:

$$\lambda_{TE_{11}n}/4 \leqq L \leqq \lambda_{TE_{11}n}/2. \tag{E6}$$

The most effective ground plane performance at resonant angular frequency $\omega_0$ occurs when $$L \rightarrow \lambda_{TE_{11}n}/4;$$

$$Z_n \rightarrow -i\infty;$$

$$Y_n \rightarrow +i0 \tag{E7}$$

The depth L is commonly chosen such that (E7) holds true starting from a little below the lowest frequency end of the GNSS spectrum. Hence (E6) holds for the entire frequency band, but the ground plane performance for upper frequencies with smaller $\lambda_{TE_{11}n}$ generally diminishes. The frequency behavior within the frequency band is characterized by the derivative of $Y_n$ with respect to frequency:

$$\lim_{\omega \to \omega_0} \frac{\partial\, Im\left(Y_n\left(\omega, L = \frac{\lambda_{TE11n}}{4}\right)\right)}{\partial \omega} = \frac{\pi}{2W\omega_0}\frac{\lambda_{TE11n}}{\lambda_0}, \tag{E8}$$

where $\lambda_0$ is the free-space wavelength at resonant frequency $\omega_0$. $\lambda_{TE11n} > \lambda_0$ holds true for any groove. $\lambda_{TE11n}$ is the largest for the groove with the smallest $R_n$. Consequently, the first groove with radius $R_1$ characterizes the ground plane frequency behavior to a large extent.

Figure 5A:
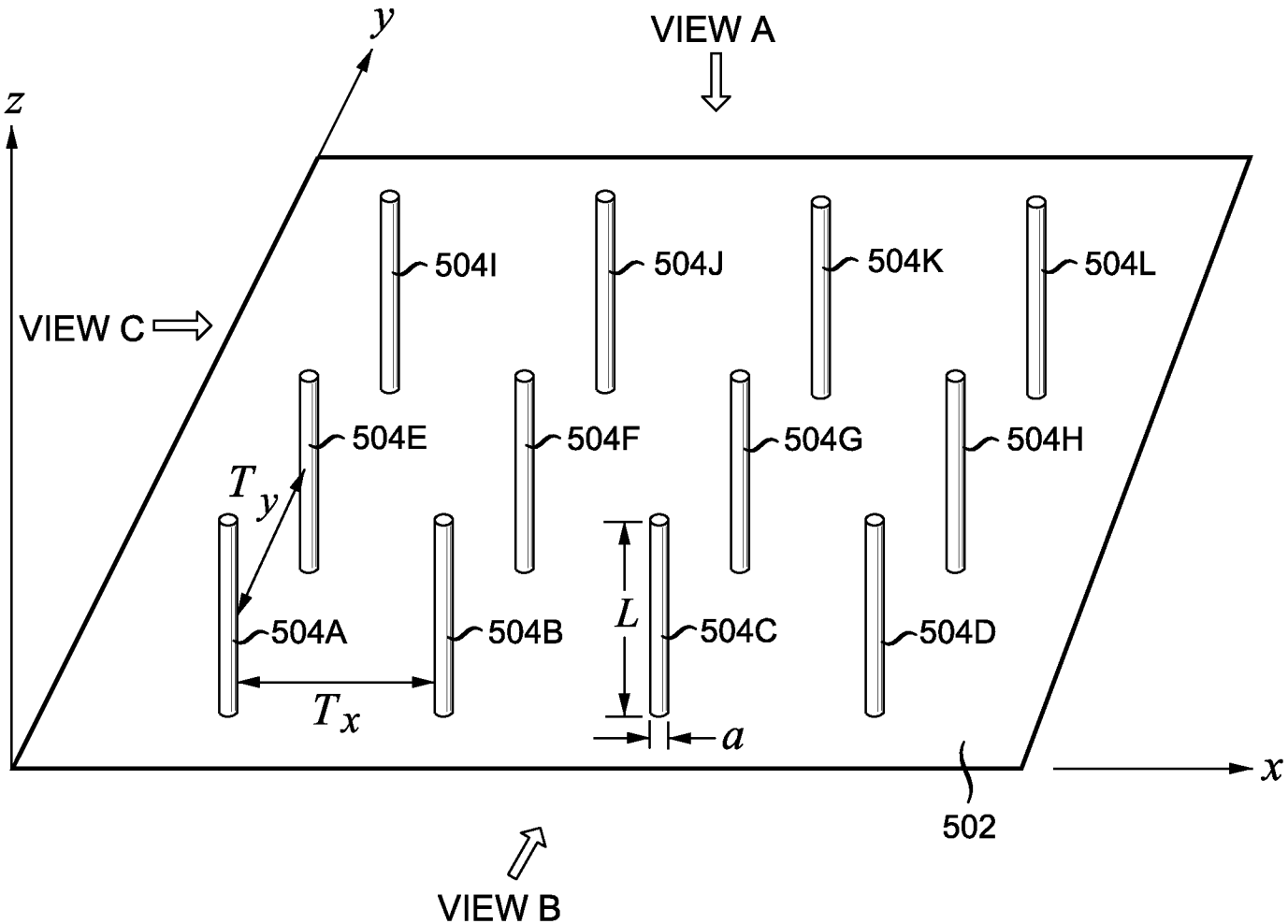
FIG. 5A-FIG. 5D show a flat ground plane with an array of pins.
Figure 5B:
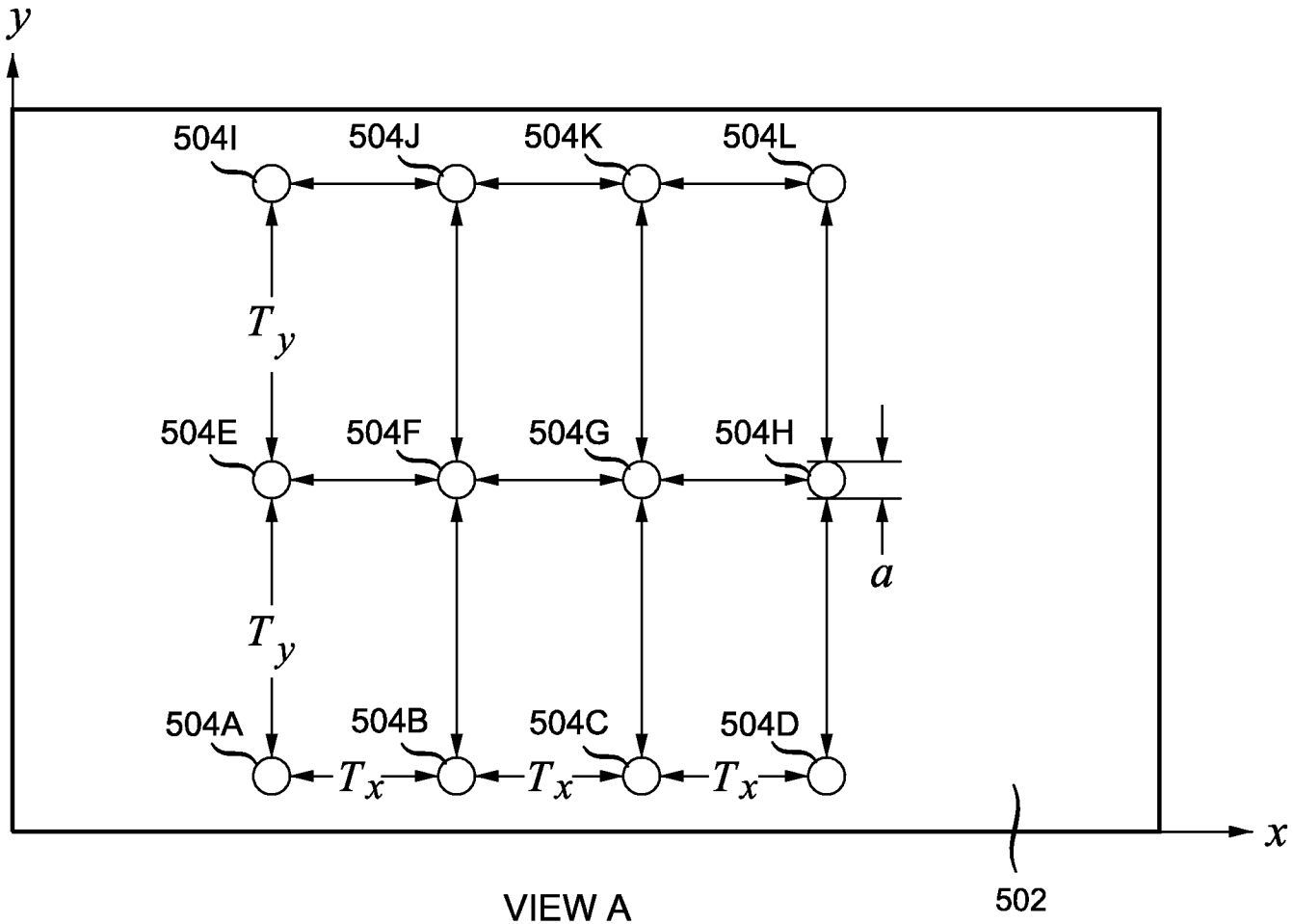
Figure 5C:
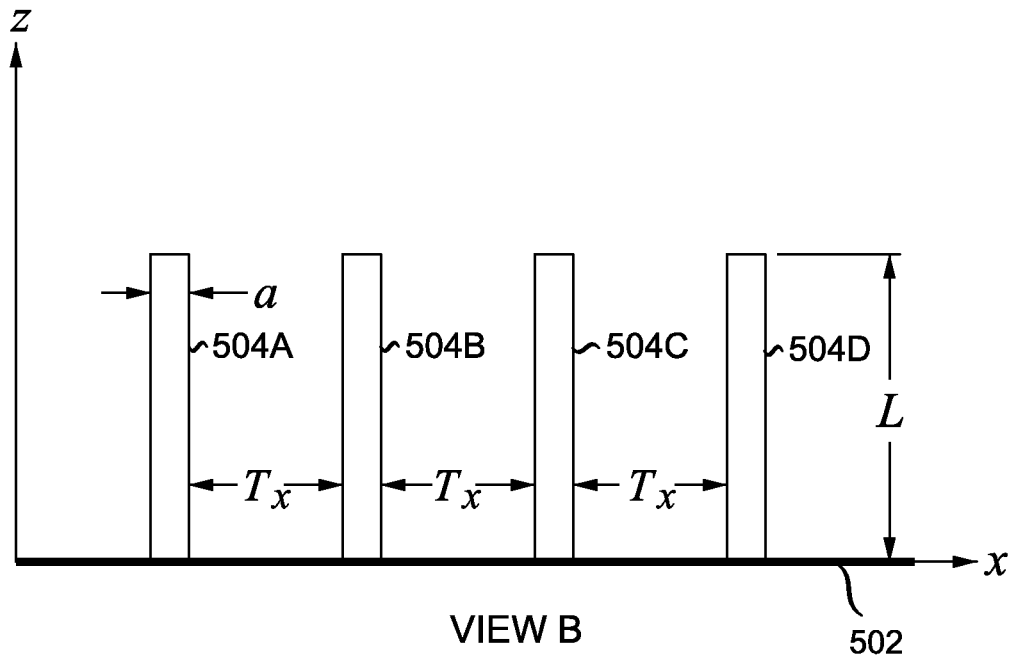
Figure 5D:
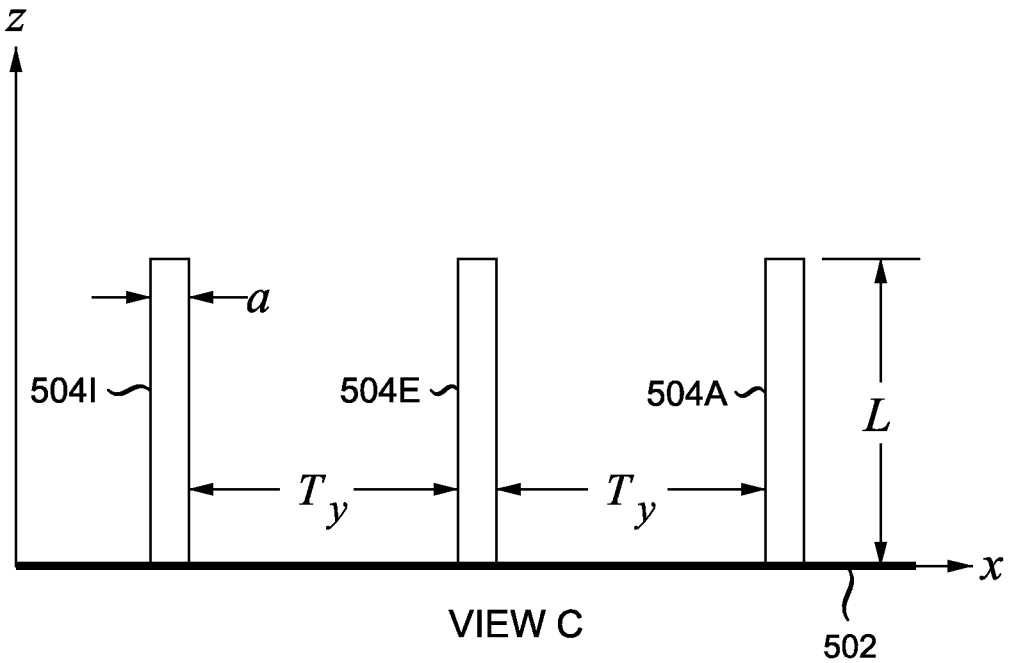

To make the derivative (E8) smaller, consider the structure shown in FIG. 5A-FIG. 5D. FIG. 5A is a perspective view; FIG. 5B is View A, sighted along the −z direction; FIG. 5C is View B, sighted along the +y direction; and FIG. 5D is View C, sighted along the +x direction. Note that the figures are not to scale. The structure includes a rectangular array of conducting pins of length (height) L and radius a/2 disposed on and attached to a conducting plane 502. In the example shown in FIG. 5A-FIG. 5D, there are twelve conducting pins, labelled pin 504A-pin 504L, configured in an array of three rows along the y-axis and four columns along the x-axis. $T_x$, $T_y$ are the array periods along the x-axis, y-axis, respectively. In general, the number of rows and the number of columns are user-specified.

Assume that $a \ll T_x, T_y$, and consider the case when $$L \geq \frac{\lambda}{4}.$$

To analyze this structure, a computer simulation code has been developed. The code is based on electromagnetic periodic structures theory (see, for example, N. Amitay, V. Galindo, and C. P. Wu "Theory and Analysis of Phased Array Antennas", Wiley-Interscience, New York, 1972) combined with a Galerkin technique (see, for example, R. E. Collin, "Field Theory of Guided Waves", Wiley-IEEE Press, 1990). Details of the numerical algorithm are provided in Appendix A below.

Figure 6A:
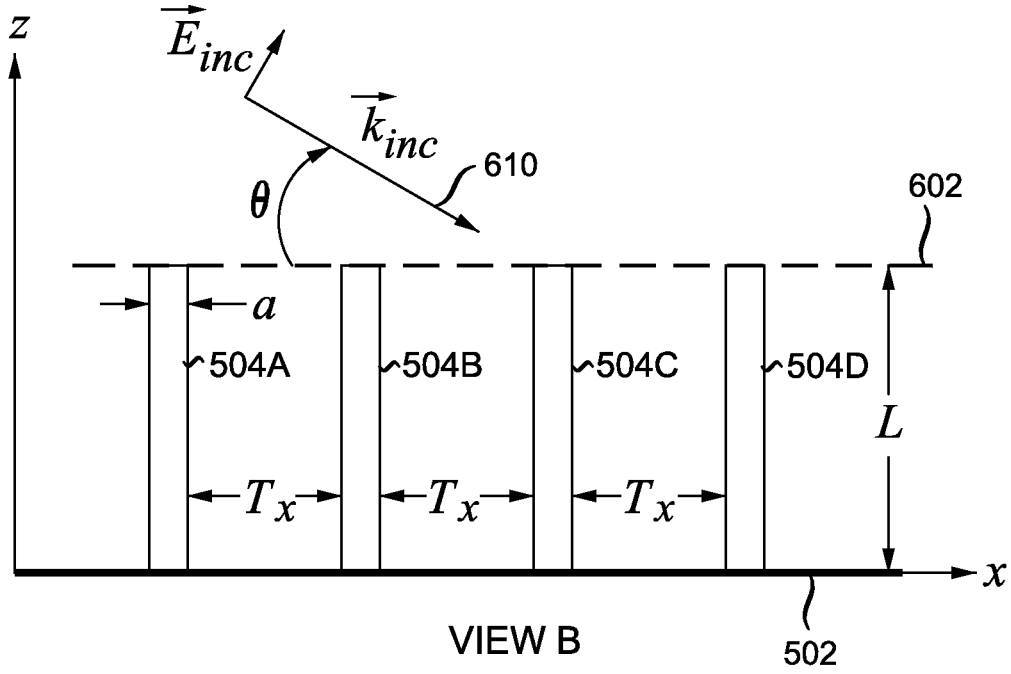
FIG. 6A shows the geometry of a ray incident on a flat impedance surface at the top of an array of pins on a flat ground plane.

The electromagnetic plane wave reflection from the structure in FIG. 6A is discussed. An electromagnetic wave 610, with k-vector $\vec{k}_{inc}$ and E-vector $\vec{E}_{inc}$, is incident upon the impedance surface 602 with an angle of incidence θ. Once the reflection coefficient C is known, the equivalent surface impedance of the structure is calculated as:

$$Z = W\sin(\theta)\frac{1+C}{1-C}. \tag{E9}$$

Figure 7:
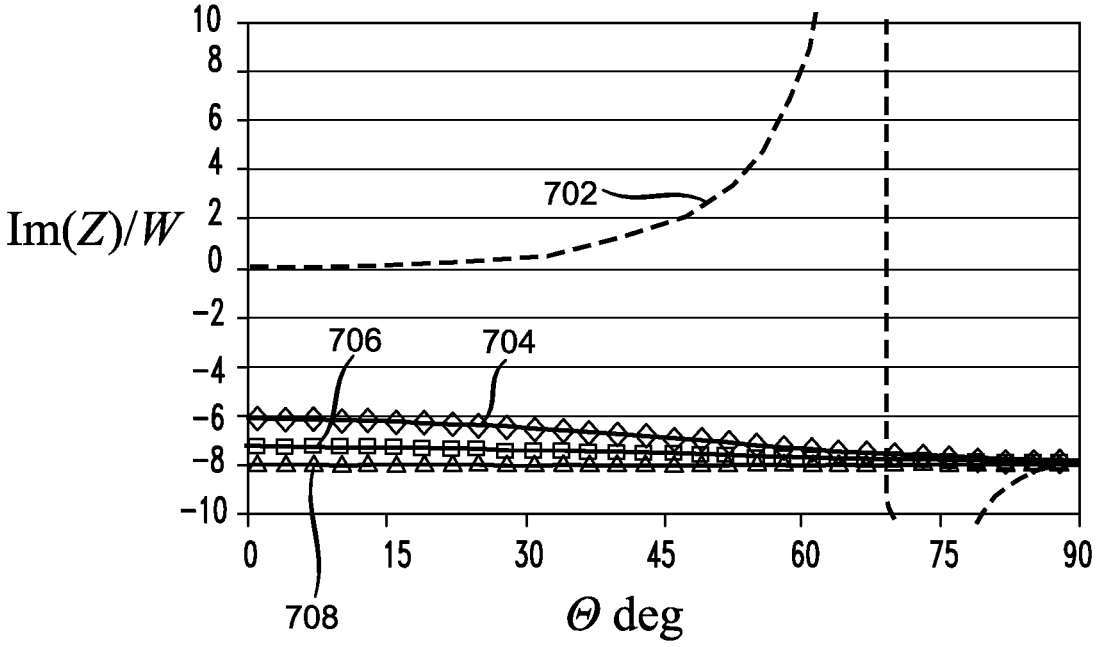
FIG. 7 shows plots of impedance as a function of incident angle.

FIG. 7 shows a plot of the imaginary part of the impedance (normalized by a factor of 1/W) Im(Z)/W as a function of the incident angle θ. Plot 702 shows the dependence of impedance along the surface distant from an ideally-conducting flat surface by distance L for the case in which there is no pin structure. Plot 704, plot 706, and plot 708 show the results for pin structures with different values of $T=T_x=T_y$. Plot 704 shows the dependence of impedance for $T=T_x=T_y=0.20\lambda$. Plot 706 shows the dependence of impedance for $T=T_x=T_y=0.15\lambda$. Plot 708 shows the dependence of impedance for $T=T_x=T_y=0.10\lambda$. For T less than 0.15λ, the plots indicate that the surface impedance of the structure is independent of the incident angle. This result shows that the structure within this range of values of T comprises an impedance surface on the top of the pins with impedance being independent of the incident electromagnetic field.

To estimate the frequency response of the structure, note, that for the incident angle θ=90°, the E-field vector of an incident wave is perpendicular to the pins. Hence, there is no electrical current on the pins. The wave is reflected by the metal plane 502, with the impedance at the top of the pins being $$Z_{\theta=90^\circ} = \frac{1}{Y_{\theta=90^\circ}} = iW\tan(kL). \tag{E10}$$

For grazing incidence with θ≈0°, the impedance at the top of the pins is (as derived below in Appendix A):

$$Z_{\theta=0^\circ} = \frac{1}{Y_{\theta=0^\circ}} = iW\frac{1}{\frac{\pi^2}{8kL}-\frac{kL}{2}}. \tag{E11}$$

The frequency dependence of both (E10) and (E11) are the same and given by:

$$\lim_{\omega\to\omega_0}\frac{\partial Y\left(\omega_0, L=\frac{\lambda}{4}\right)_{\theta=0^\circ}}{\partial\omega} = \lim_{\omega\to\omega_0}\frac{\partial Y\left(\omega_0, L=\frac{\lambda}{4}\right)_{\theta=90^\circ}}{\partial\omega} = \frac{\pi}{2W\omega_0}. \tag{E12}$$

Note that (E12) is smaller than (E8). In particular, for a typical value of $R_1=0.25\lambda_0$, the derivative (E12) is 30% less compared to (E8). Therefore, such a pin impedance structure possesses broader-band characteristics in comparison with a coaxial waveguide structure.

A comparison between flat and convex impedance ground planes is discussed here. As already mentioned above, analysis of basic performance features for both types does not require the impedance structure type to be fixed, but rather does require that the impedance behavior holds true. Also, since a comparative analysis, rather than exact design calculations, is being considered here, simplified two-dimensional (2-D) models are used. In one model, an omnidirectional magnetic line current is used as a source. To perform more exact calculations, integral equations techniques with Galerkine numerical schemes can be used.

Figure 6B:
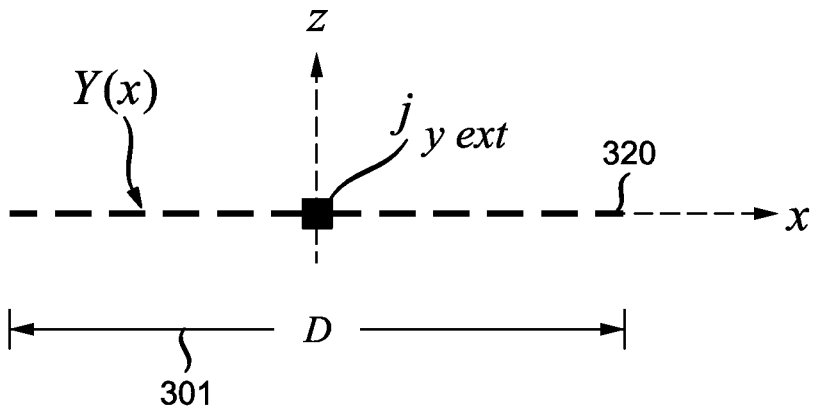
FIG. 6B shows a two-dimensional model of a flat impedance surface corresponding to a choke ring.

FIG. 6B shows the electromagnetic 2-D problem for the flat impedance surface of a choke ring. Here, the impedance surface 320 is represented by the thick dashed line. It is excited by an omni-directional line source placed in the middle of the structure; $j_{y\ ext}$ is the filament of magnetic current. The integral equation to be solved is:

$$\int_{-\frac{D}{2}}^{\frac{D}{2}}(f(x')+f^{inc}(x'))G(x,x')dx' = f(x)Y(x). \tag{E13}$$

Here f(x) is an unknown function equal to the tangential E-field component distribution along the surface; $f^{inc}$ (x) is the corresponding function for the source; G(x,x') is the Green's function; and Y(x) is the impedance distribution.

Figure 8A:
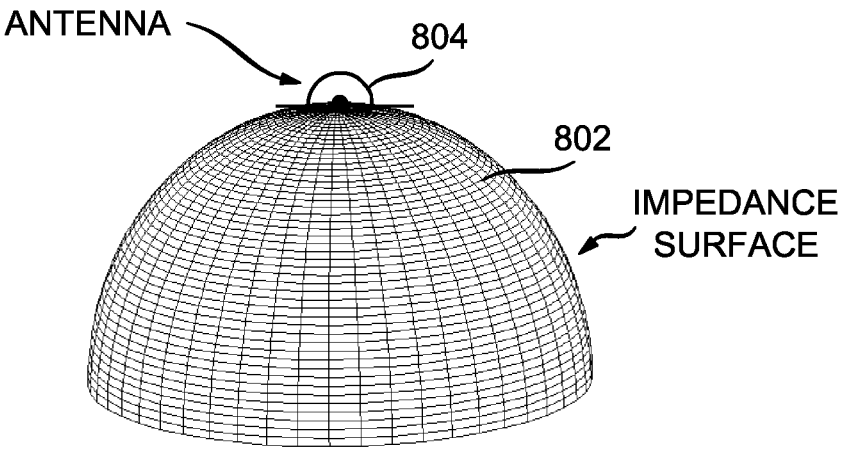
FIG. 8A shows an antenna mounted on a hemispherical impedance surface.
Figure 8B:
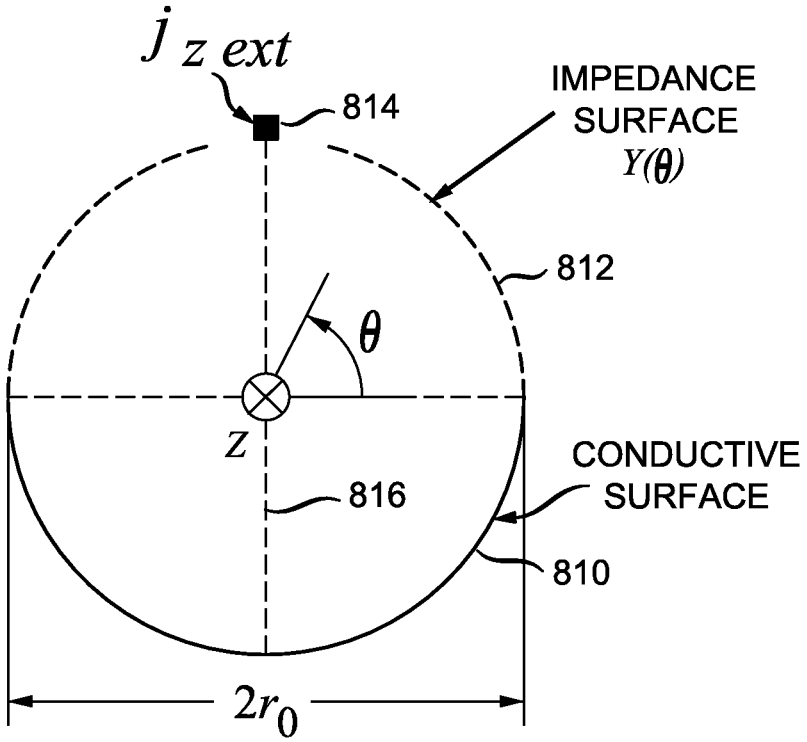
FIG. 8B shows a two-dimensional model of a hemispherical impedance surface.

Now consider a hemispherical impedance surface. FIG. 8A (three-dimensional perspective view) shows an antenna 804 on top of a hemispherical impedance surface 802. For analysis, a two-dimensional (2-D) cross-sectional model, as shown in FIG. 8B, can be used. To simplify the analysis below, the excitation of a complete circle (with radius $r_0$) rather than a semicircle is treated. The top semicircle 812, indicated by the dashed line, represents an impedance surface; the bottom semicircle 810, as indicated by the solid line, represents an ideally conductive surface. This model is used because an analytic solution exists for the electromagnetic 2-D problem with a complete ideally conductive circle; therefore, the analysis is simplified. For this case, the electromagnetic field is being suppressed significantly by the impedance portion of the circle (semicircle 812); hence, the bottom ideally conducting portion (semicircle 810) does not affect the result.

Assume that the structure is symmetrical relative to the axis 816; that is, the surface admittance Y(θ)=Y(180°−θ). The equation to be solved for the circular problem is then:

$$\int_0^{2\pi}(f(\theta')+f^{inc}(\theta'))G(\theta,\theta')d\theta' = f(\theta)Y(\theta). \tag{E14}$$

Details of both the integral equation derivations and the numerical schemes are provided in Appendix B. Once the equations have been solved, the far field can be calculated, as also shown in Appendix B.

The approach described here allows for the surface admittance Y(θ) to be non-homogenous along the structure and to vary with the angle θ. This degree of freedom allows for more optimization. In some instances, the impedance surface is not limited by the top hemisphere and extends to the lower hemisphere.

Figure 9:
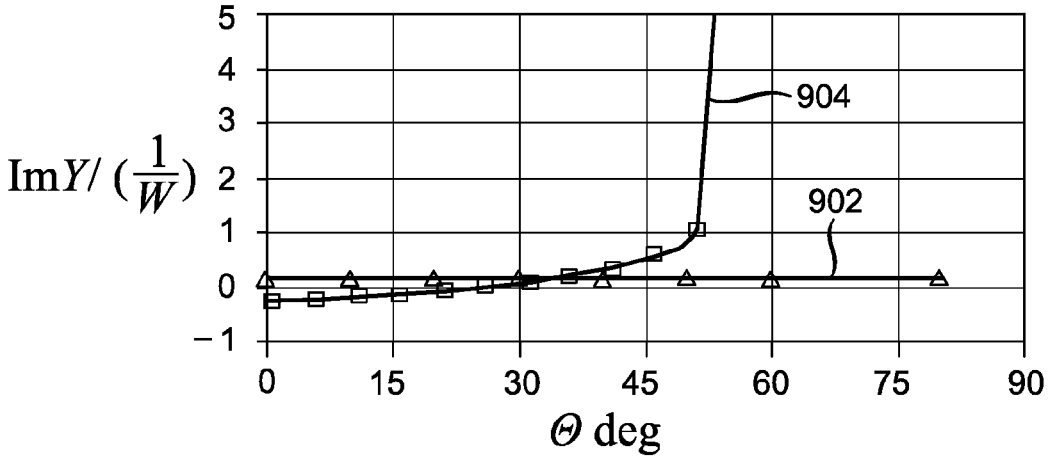
FIG. 9 shows plots of admittance as a function of incident angle.

FIG. 9 show plots of $$\mathrm{Im}Y \Big/ \left(\frac{1}{W}\right)$$

as a function of angle θ, where Im refers to the imaginary component. In plot 902, for a convex surface, the admittance is homogeneous around the structure with Im(Y)=0.126/W. In plot 904, the admittance varies along the convex surface such that Im(Y) becomes slightly negative while approaching the horizon. Normally at negative Im(Y), the regular (flat) structure would not work because of surface wave excitation (see, for example, R. E. Collin, "Field Theory of Guided Waves", Wiley-IEEE Press, 1990). With the convex surface, however, a slight surface wave does not degrade the D/U ratio; on the contrary, it contributes to further antenna gain improvement for top hemisphere directions.

According to an embodiment, user-specified impedance distribution laws (see FIG. 9) are implemented with arrays of conducting elements. The lengths of the conducting elements are determined by expression (E10). Specific embodiments of convex ground planes with an array of conducting elements disposed on them are described below.

Figure 11:
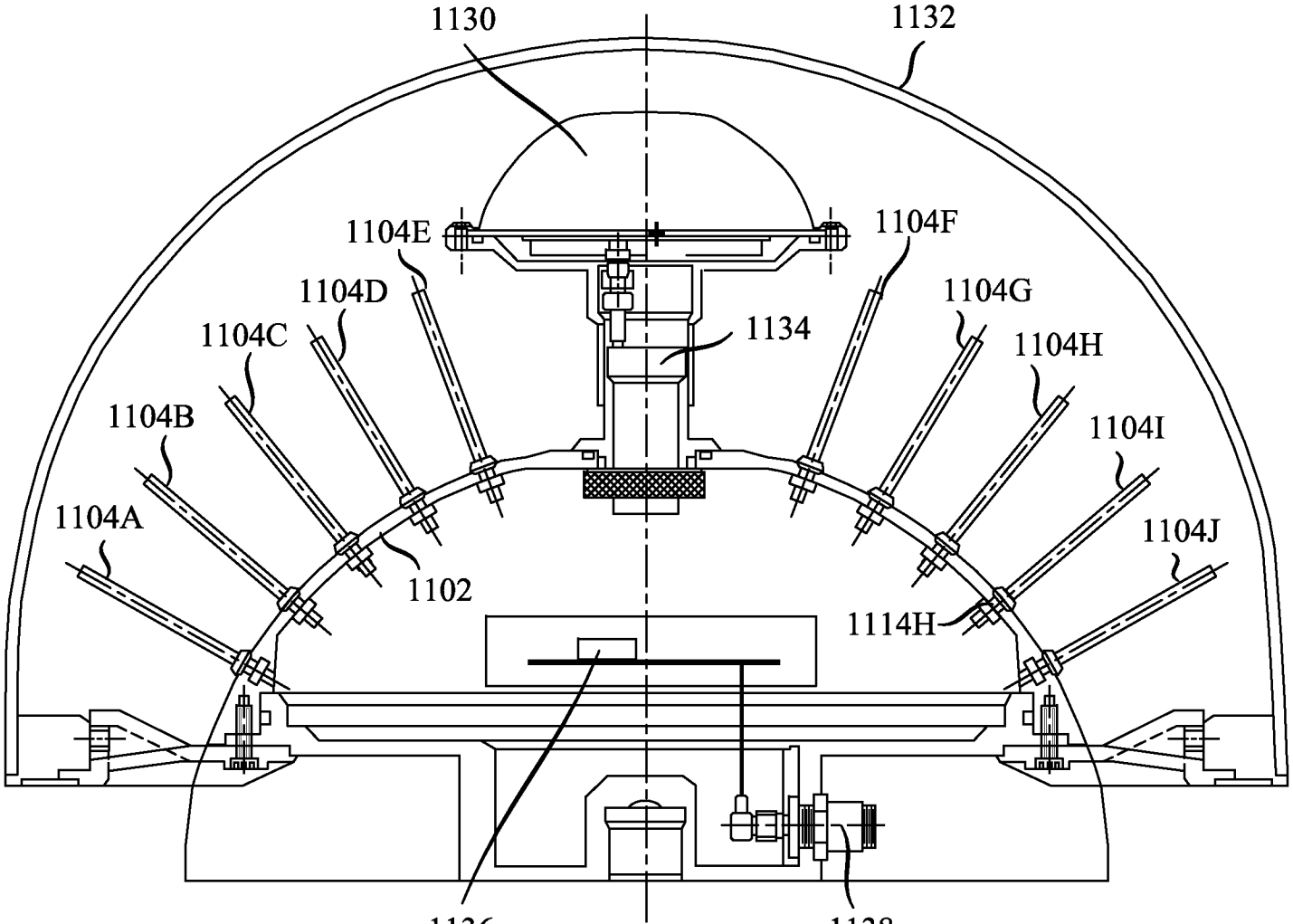
FIG. 11 shows a cut-away view of an antenna system with a convex ground plane.

A cutaway view of an embodiment of a base station antenna system is shown in FIG. 11. Antenna 1130 is mounted on a supporting block 1134, which is fastened to the surface of conducting ground plane 1102. Conducting ground plane 1102 has a convex shape, such as a portion of a spherical or ellipsoidal surface. The radius of curvature is user specified; typically the radius is approximately (0.5 to 3)λ, where, λ is the wavelength of the received signal. In an embodiment, λ is a wavelength of a global navigation satellite signal, typically a wavelength representative of the low-frequency end of the spectrum of global navigation satellite system signals for which the antenna system is designed to receive. In one embodiment, the diameter of conducting ground plane 1102 is approximately 290 mm. An array of separated conducting elements (referenced as 1104A-1104J) is fastened to the outer surface of conducting ground plane 1102. Refer to conducting element 1104H as a representative conducting element and fastener 1114H as a representative fastener. Examples of fasteners include screws, nuts, and rivets. A conducting element can also be attached to ground plane 1102 by welding, soldering, brazing, conducting adhesives, and mechanical fit (such as a press fit or a drive fit). The conducting elements and ground plane 1102 can also be fabricated as an integral unit. More details of the conducting elements are discussed below. Herein, conducting elements disposed on a conducting ground plane refer to conducting elements making electrical contact with the conducting ground plane, regardless of the method by which the conducting elements are attached, fastened, or fabricated to the conducting ground plane. The conducting ground plane and the conducting elements are typically formed from metal; however, other conducting materials can be used.

The antenna system can be configured with various system components mounted within the ground plane 1102 to form a compact unit. Examples of system components include sensors (such as inclination sensors and gyro sensors), a low-noise amplifier, signal processors, a wireless modem, and a multi-frequency navigation receiver 1136. These system components can be used to process various navigation signals, including GPS, GLONASS, GALILEO, and COMPASS. The antenna system can be enclosed by a cap (dome) 1132 to protect it from weather and tampering.

Figure 12A:
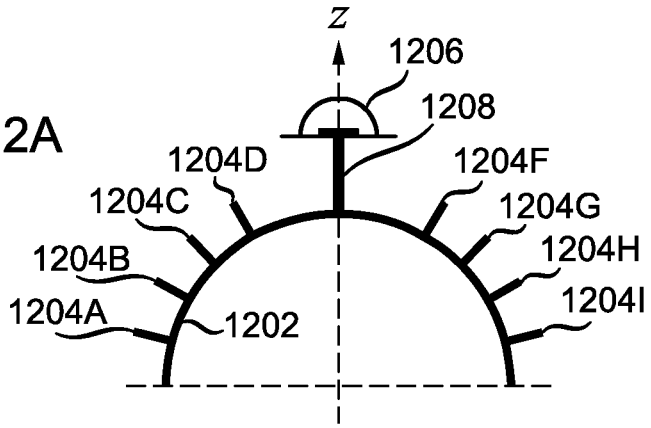
FIG. 12A-FIG. 12C show various configurations for mounting an antenna on a convex ground plane.
Figure 12B:
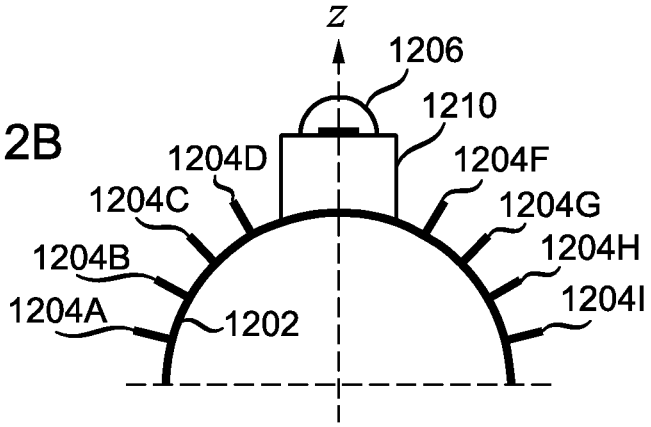
Figure 12C:
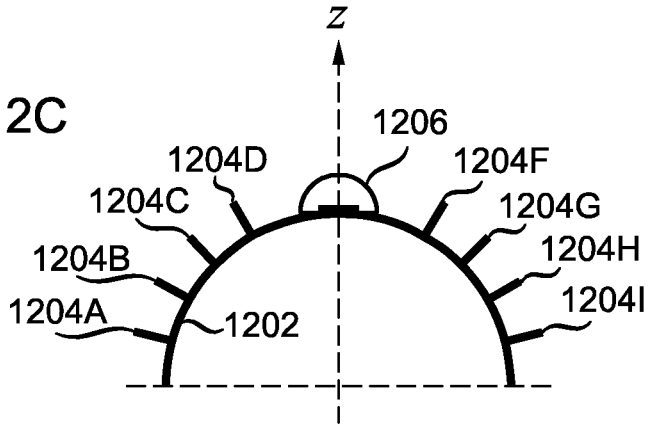

Various configurations for mounting the antenna on the ground plane can be used. FIG. 12A-FIG. 12C show three embodiments. In these figures, the antenna system comprises an antenna 1206 (shown with a protective dome on only the antenna itself) mounted on a convex ground plane 1202 fitted with an array of pins (pin 1204A-pin 1204I). To simplify the figure, not all the elements of antenna 1206 are shown. In FIG. 12A, antenna 1206 is mounted on a post 1208 that is attached (mounted) to convex ground plane 1202. The distance (height) between the antenna 1206 and the convex ground plane 1202 is user specified. In FIG. 12B, the antenna 1206 is mounted on a platform 1210 attached (mounted) to the convex ground plane 1202. The distance (height) between the antenna 1206 and the convex ground plane 1202 is user specified. In FIG. 12C, the antenna 1206 is mounted directly on convex ground plane 1202. In some embodiments, the antenna is connected to the ground plane via an electrically conductive path. In other embodiments, the antenna is electrically isolated from the ground plane. For example, in FIG. 12A, post 1208 can be fabricated from a conductive metal or a dielectric insulator. As another example, in FIG. 12C, antenna 1206 can have electrical contact with ground plane 1202, or antenna 1206 can be dielectrically isolated (for example, via a dielectric layer, spacers, or standoffs) from ground plane 1202. Herein, a structure between the antenna and the convex ground plane is referred to as a support structure. The support structure is mounted on the convex ground plane, and the antenna is mounted on the support structure. In some embodiments, the support structure is a conductor; in other embodiments, the support structure is a dielectric.

Figure 13A:
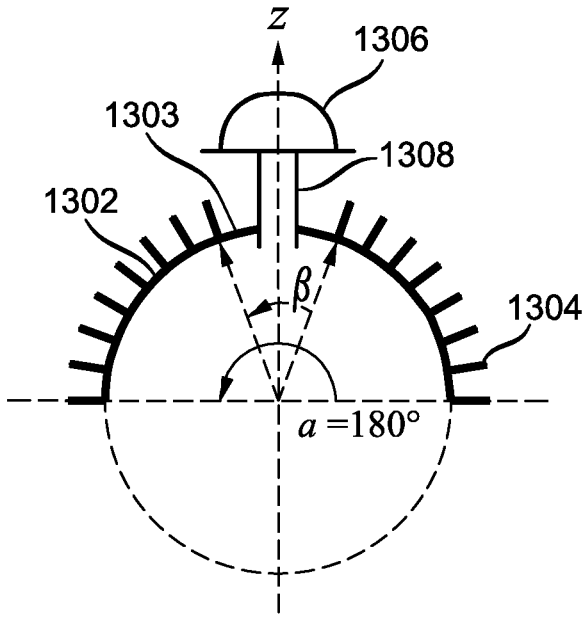
FIG. 13A-FIG. 13D show various configurations of convex ground planes subtending different portions of a spherical surface.
Figure 13B:
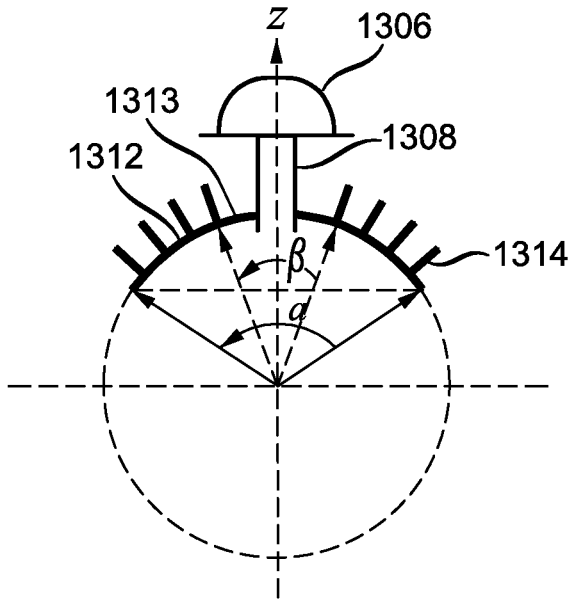
Figure 13C:
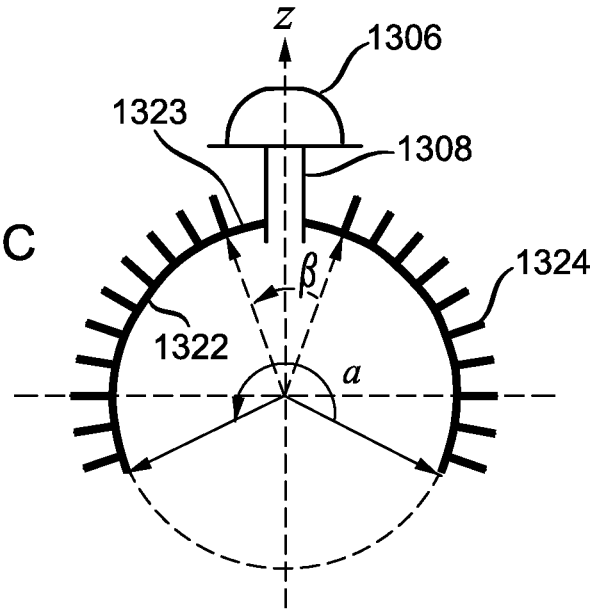
Figure 13D:
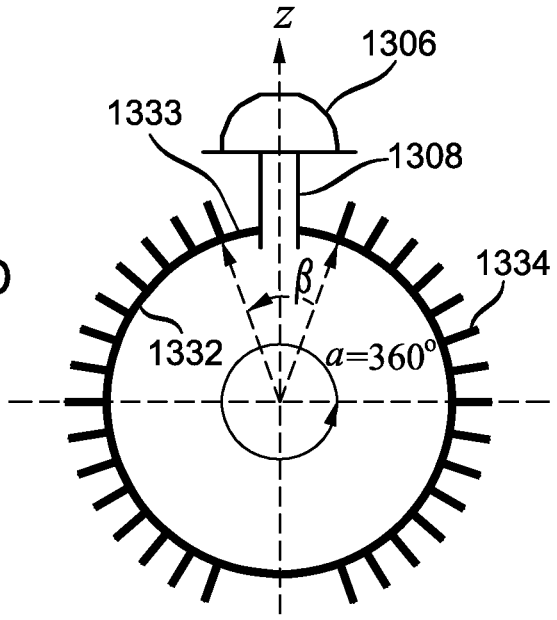

The convex ground plane can be a portion of a sphere (including a hemisphere, a portion less than a hemisphere, and a portion greater than a hemisphere), or a full sphere. Four examples are shown in FIG. 13A-FIG. 13D. In FIG. 13A, antenna 1306 is mounted on a post 1308 which is attached to a convex ground plane 1302 fitted with an array of pins 1304 (to simplify the figure, the individual pins are not labelled). The geometry of convex ground plane 1302 is a hemisphere (subtended angle α=180 deg). There are no pins located within region 1303 of the convex ground plane 1302. Region 1303 is delimited by the subtended angle β about the z-axis. In an embodiment, the range of subtended angle β is approximately 0 to 45 deg. Region 1303 can be approximated by an ideal conducting surface (zero impedance). In FIG. 13B, the convex ground plane 1312 is fitted with an array of pins 1314. The geometry of convex ground plane 1312 is a portion of a sphere (subtended angle is α<180 deg). There are no pins located within region 1313 of the convex ground plane 1312. Region 1313 is delimited by the subtended angle β about the z-axis. The permissible range of subtended angle β varies with the subtended angle α. Region 1313 can be approximated by an ideal conducting surface (zero impedance). In FIG. 13C, the convex ground plane 1322 is fitted with an array of pins 1324. The geometry of convex ground plane 1322 is a portion of a sphere (subtended angle is 180 deg<α<360 deg). There are no pins located within region 1323 of the convex ground plane 1322. Region 1323 is delimited by the subtended angle β about the z-axis. In an embodiment, the range of subtended angle β is approximately 0 to 45 deg. Region 1323 can be approximated by an ideal conducting surface (zero impedance). In FIG. 13D, the convex ground plane 1332 fitted with an array of pins 1334. The geometry of convex ground plane 1332 is a complete sphere (subtended angle α=360 deg). There are no pins located within region 1333 of the convex ground plane 1332. Region 1333 is delimited by the subtended angle β about the z-axis. In an embodiment, the range of subtended angle β is approximately 0 to 45 deg. Region 1333 can be approximated by an ideal conducting surface (zero impedance).

In other embodiments, other user-defined portions of the convex ground plane can be free of conducting elements. In general, the array of conducting elements can be disposed on a user-defined portion of the convex ground plane.

In the embodiments described above with reference to FIG. 13A-FIG. 13D, the convex ground plane comprised a sphere or a portion of a sphere. In general, the surface of a convex ground plane can be described by a user-defined function $r=r(\theta,\phi)$, where $(r,\theta,\phi)$ are the spherical coordinates of a point on the convex ground plane with respect to an origin O (see FIG. 1). In an embodiment, $r(\theta)=r_0-r_1(\theta)$, where:

- $r(\theta)$ is the radius from the origin O to a point on the convex conducting surface with meridian angle θ;
- $r_0$ is a constant with a value ranging from approximately (0.5-1.5)λ, where λ is a wavelength of a global navigation satellite system signal; and
- $r_1(\theta)$ is a user-defined function with a magnitude $|r_1(\theta)|\leqq 0.25\lambda$.

Figure 16A:
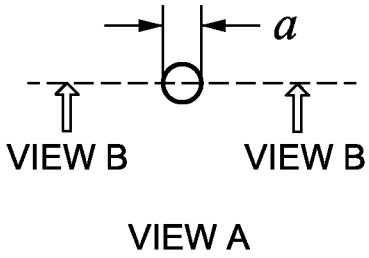
FIG. 16A and FIG. 16B show an embodiment of a conducting element.
Figure 16B:
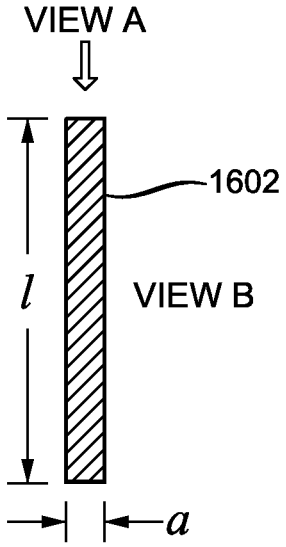
Figure 20A:
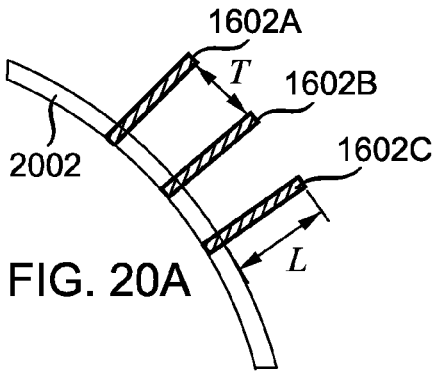
FIG. 20A-FIG. 20F show various embodiments of conducting elements disposed on a convex ground plane.

Conducting elements can have shapes other than cylindrical pins. In general, a conducting element has an elongated body structure, with transverse dimensions substantially less than the length. In some embodiments, the ratio of the transverse directions to the length is approximately 0.01 to 0.2. Other examples of shapes include ribs and teeth. FIG. 16A-FIG. 16D show examples of various conducting elements. FIG. 16A shows a top view (View A) and a longitudinal (parallel to the long axis) cross-sectional view (View B) of a conducting element 1602 comprising a cylindrical pin with diameter a and length l. The pins can have various transverse (perpendicular to long axis) cross-sections, including: circular, elliptical, square, rectangular, triangular, trapezoidal, polygonal, and curvilinear. Corresponding three-dimensional shapes include cylinders, cones, truncated cones, rectangular prisms, trapezoidal prisms, pyramids, and polyhedra. FIG. 20A shows a series of three conducting elements 1602 (labelled 1602A-1602C) attached to convex ground plane 2002. In FIG. 20A-FIG. 20D, L represents the height of the conducting element above the surface of the convex ground plane; T represents the spacing between the conducting elements (the positions at which the spacing T is defined depends on the geometrical configuration).

Figure 17A:
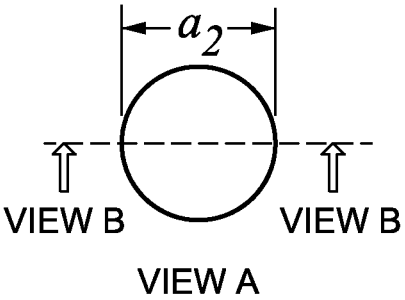
FIG. 17A-FIG. 17C show an embodiment of a conducting element.
Figure 17C:
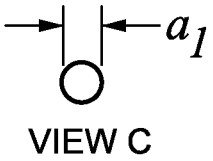
Figure 17B:
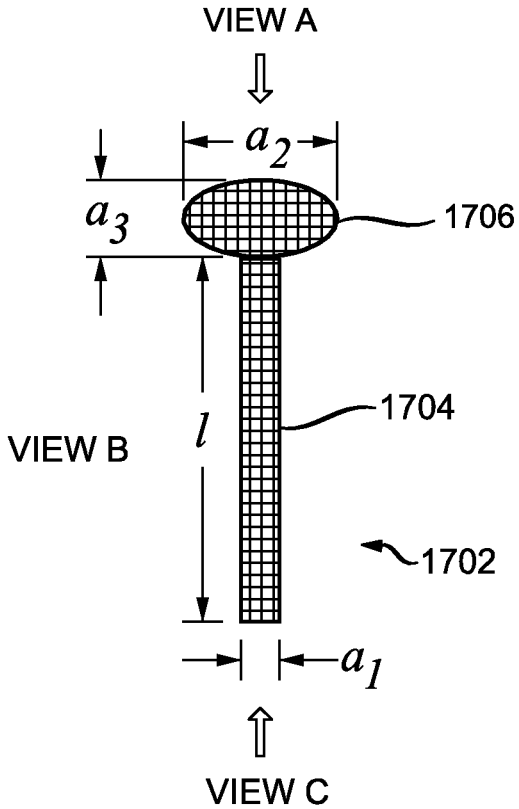
Figure 20B:
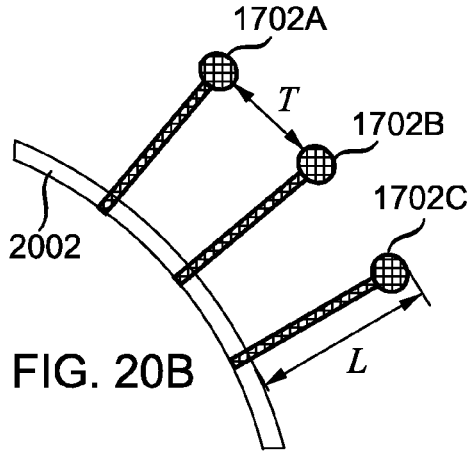

In addition to an elongated body structure, a conducting element can have a tip structure. FIG. 17A-FIG. 17C show different views of a conducting element 1702 comprising a cylindrical body 1704 and a tip structure shaped as an ellipsoidal head (cap) 1706. The cylindrical body 1704 has a diameter $a_1$ and a length l. The ellipsoidal head 1706 has a diameter $a_1$ and a height $a_3$. FIG. 20B shows a series of three conducting elements 1702 (labelled 1702A-1702C) attached to convex ground plane 2002.

Other examples of shapes for tip structures include a portion of a sphere (including a hemisphere), a sphere, a portion of an ellipsoid (including a semi-ellipsoid), a cylinder (including both circular and non-circular cross-sections), a flat disc, a cone, a truncated cone, an n-sided prism, and an n-sided pyramid (where n is an integer greater than or equal to 3). A selection of representative shapes is shown in FIG. 21A-FIG. 21C, FIG. 22A-FIG. 22C, FIG. 23A-FIG. 23C, and FIG. 24A-FIG. 24C. In each of these examples, the conducting element comprises the same cylindrical body 1704 as shown in FIG. 17B plus a distinctive tip structure. Refer to FIG. 21A-FIG. 21C. Conducting element 2102 has a spherical tip structure 2106 with a diameter $a_2$. Refer to FIG. 22A-FIG. 22C. Conducting element 2202 has a cylindrical tip structure 2206 with a diameter $a_2$ and a length (height) $a_3$. For $a_3 \ll a_1$, cylindrical tip structure 2206 has the geometry of a flat disc. Refer to FIG. 23A-FIG. 23C. Conducting element 2302 has a rectangular prism tip structure 2306 with dimensions $(w_1, w_2, w_3)$. If two of the dimensions are equal, rectangular prism tip structure 2306 has a square cross-section. If all three dimensions are equal, rectangular prism tip structure 2306 has the geometry of a cube. Refer to FIG. 24A-FIG. 24C. Conducting element 2402 has a semi-ellipsoidal tip structure 2406 with minor axis $w_1$, major axis $w_2$, and height $w_3$. In some embodiments, $w_1 \sim w_2$ and $w_3 \ll w_1, w_2$.

Figure 20C:
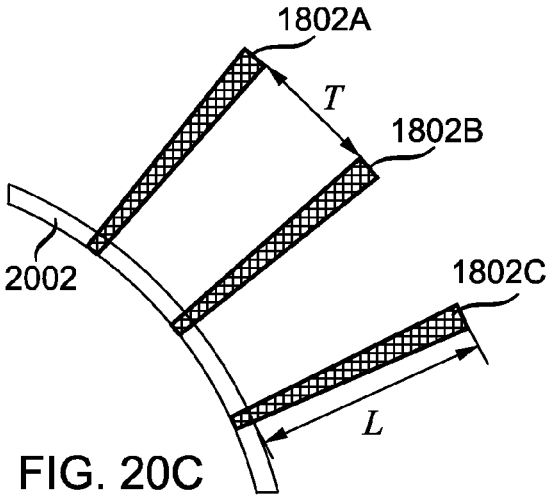

FIG. 18A-FIG. 18C illustrate a conducting element comprising a truncated conical body 1804 and a cylindrical bottom 1806. The truncated conical body 1804 has a wide diameter $a_2$, a small diameter $a_1$, and a length (height) $l_1$. The cylindrical bottom 1806 has a diameter $a_1$ and a length $l_2$. FIG. 20C shows a series of three conducting elements 1802 (labelled 1802A-1802C) attached to convex ground plane 2002.

Figure 20D:
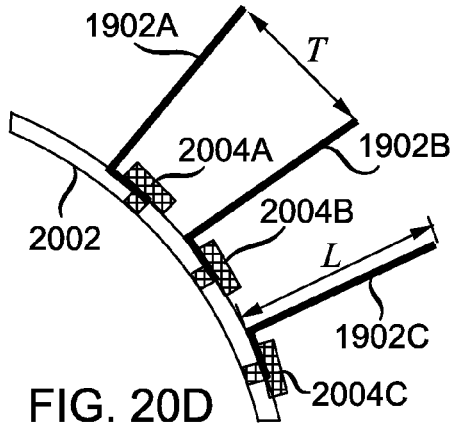
Figure 20E:
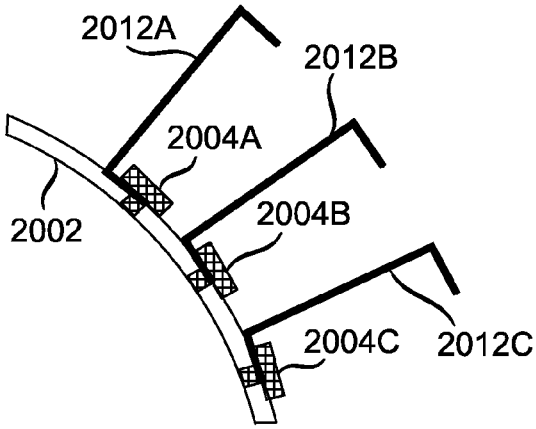
Figure 20F:
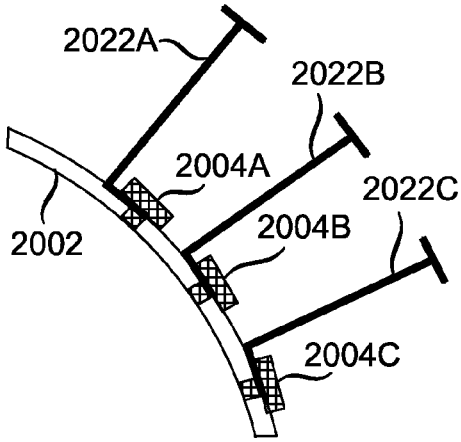

In other embodiments, conducting elements can be fabricated from sheet metal. FIG. 19A-FIG. 19C illustrate a conducting element 1902 formed from a sheet metal strip with a width $a_1$ and a thickness $a_2$. The main body 1904 has a length $l_1$. The conducting element can have an L-shape, terminating in bottom segment 1906 with length $l_2$ only; or it can have a T-shape, terminating in bottom segment 1906 and bottom segment 1908. FIG. 20D shows a series of three L-shaped conducting elements 1902 (labelled 1902A-1902C) attached to convex ground plane 2002 by fastener 2004A-fastener 2004C, respectively. An example of a suitable fastener is a rivet. In other embodiments, the tips (above the conducting ground plane) of the conducting elements are L-shaped (conducting elements 2012A-2012C in FIG. 20E) or T-shaped (conducting elements 2022A-2022C in FIG. 20F). Herein, the L-shaped tip is referred to as an elbow tip structure; and the T-shaped tip is referred to as a tee tip structure.

Figure 14:
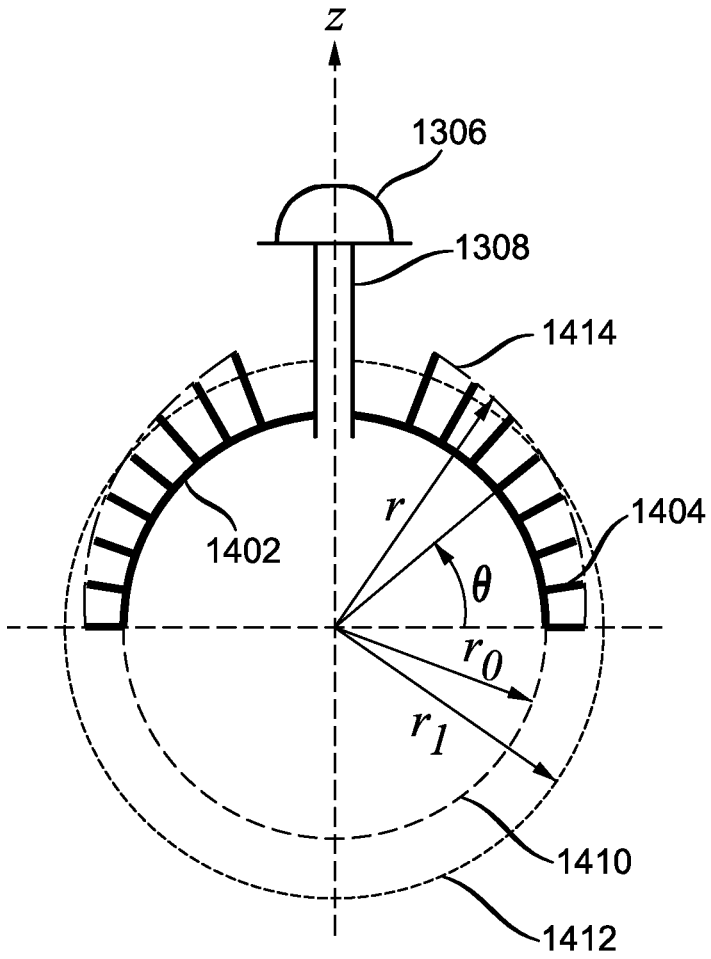
FIG. 14 shows a configuration of a convex ground plane in which the length of the conducting elements vary as a function of meridian angle.

The heights of the conducting pins do not need to be constant. In the embodiment shown in FIG. 14, an array of conducting elements 1404 are disposed on convex ground plane 1402, which has a hemispherical shape with radius $r_0$. In the plane of the figure, contour 1410 is a reference circle with radius $r_0$; and contour 1412 is a reference circle with radius $r_1$. Contour 1414 is a curve $r(\theta)$ traced by the tops of the array of conducting elements 1404. The height (length) of a conducting element is a function of the meridian angle θ: $L(\theta)=r(\theta)-r_0$. In the example shown in FIG. 14, $L(\theta)$ is a user-defined increasing function of θ. The height is constant as a function of azimuth angle φ.

Figure 15:
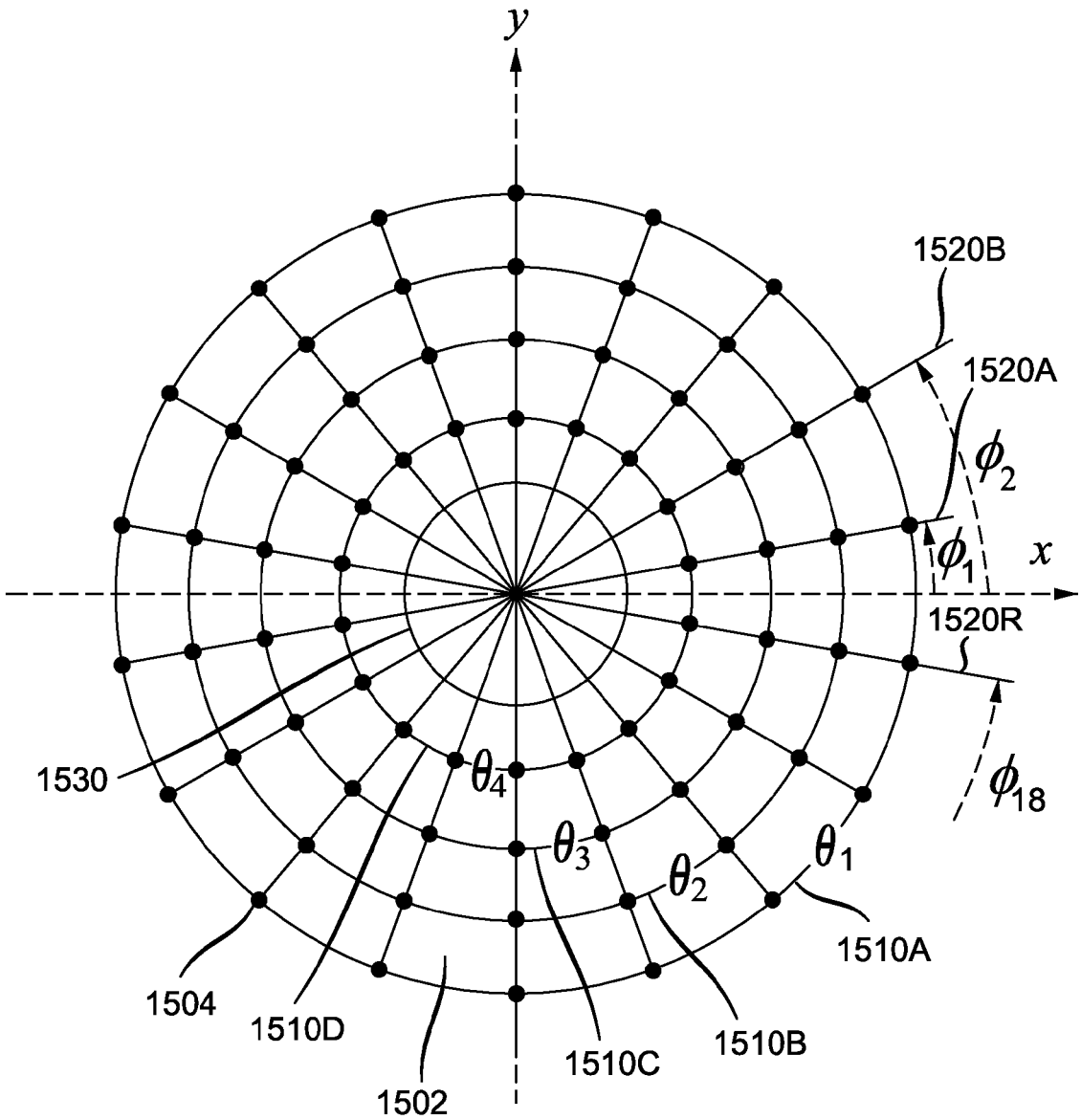
FIG. 15 shows a polar projection map of a set of points at which an array of conducting elements are located on a hemispherical convex ground plane.

FIG. 15 shows a polar projection map of a hemispherical convex ground plane 1502. The z-axis is pointing out of the plane of the figure. Shown is a set of points 1504 that mark the intersections of an array of conducting elements (not shown) with the convex ground plane 1502. The set of points 1504 are configured along circles of constant meridian angle θ and along lines of constant azimuth angle φ. Circle 1510A-circle 1510D correspond to meridian angles $\theta_1$-$\theta_4$, respectively. Line 1520A-1520R correspond to azimuth angles $\phi_1$-$\phi_{18}$, respectively. To simplify the figure, only line 1520 A, line 1520B, and line 1520R are explicitly called out. In general, the configuration of the set of points 1504 is user-specified. An antenna (not shown) can be mounted within the region bounded by circle 1530. The antenna, for example, can be a multi-band micropatch antenna.

In the example shown in FIG. 15, the number of points on each circle of constant meridian angle is the same (18), and the points all fall on the same set of lines of constant azimuth angle. The set of lines of constant azimuth angle are symmetrically distributed about the z-axis, and the increment of azimuth angle between any two adjacent lines of constant azimuth angle is 20 deg. In general, the number of points on each circle can be different, and the azimuth angles of the points on one circle can be different from the azimuth angles on another circle, as long as the overall set of points is azimuthally symmetric about the z-axis. Examples of other representative geometries are shown in FIG. 25 and FIG. 26.

Figure 25:
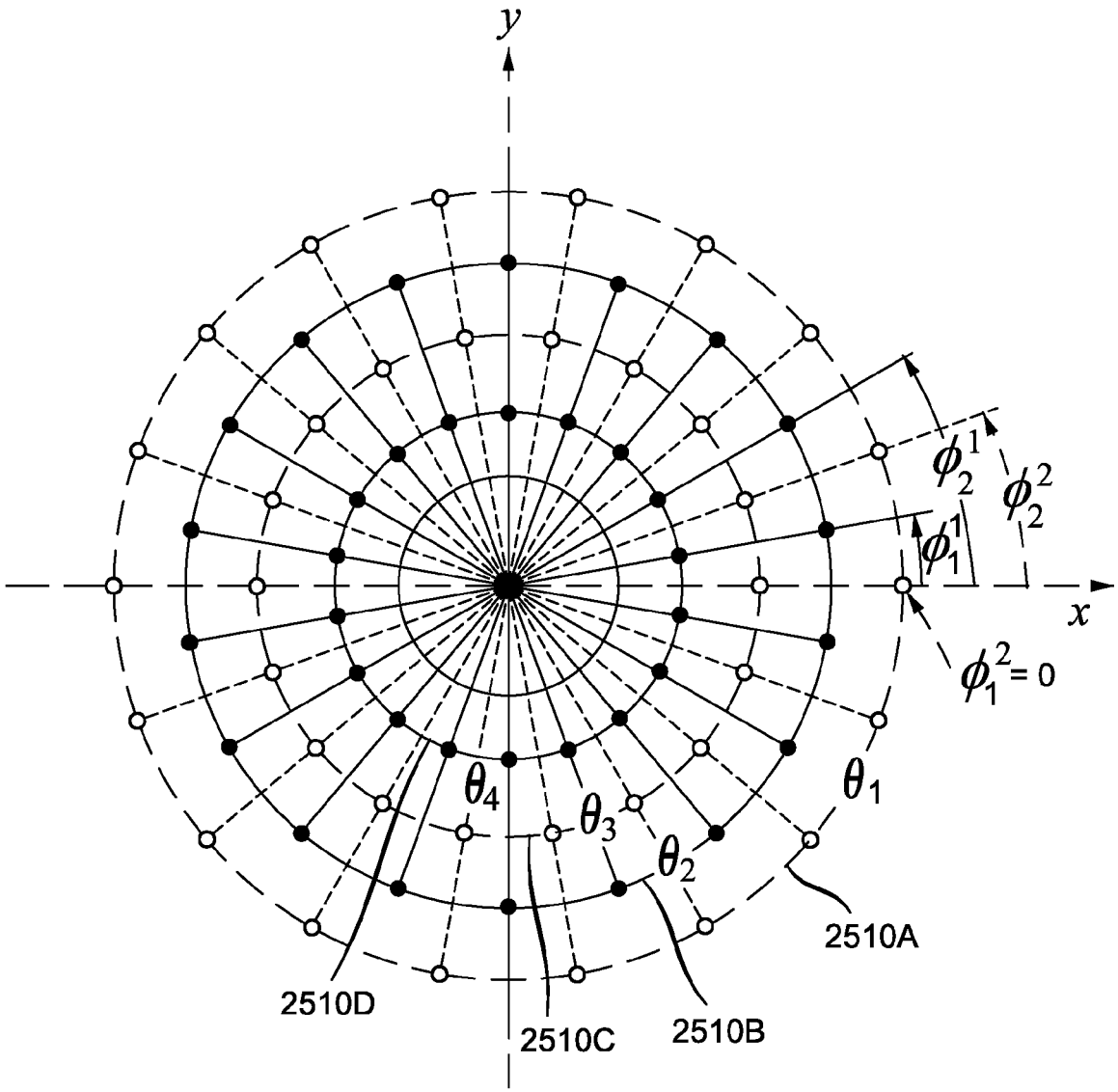
FIG. 25 shows a polar projection map of two subsets of points at which an array of conducting elements are located on a hemispherical convex ground plane, wherein the increment of azimuth angle in the first subset is equal to the increment of azimuth angle in the second subset, and the azimuth offset angle is non-zero.

Refer to the polar projection map shown in FIG. 25. The set of points are configured along circles of constant meridian angle θ. Circle 2510A-circle 2510D correspond to meridian angles $\theta_1$-$\theta_4$, respectively. With respect to azimuth angle, the set of points are partitioned into two subsets, $S^1$ and $S^2$. The subset $S^1$, represented by the filled circles, have corresponding azimuth angles belonging to the set $\phi^1=(\phi_1^1, \phi_2^1, \ldots, \phi_j^1, \phi_{j+1}^1, \ldots \phi_M^1)$, where j, M are integers. The points in $S^1$ are configured along circle 2510B and circle 2510D. The subset $S^2$, represented by the open circles, have corresponding azimuth angles belonging to the set $\phi^2=(\phi_1^2, \phi_2^2, \ldots, \phi_j^2, \phi_{j+1}^2, \ldots, \phi_M^2$. The points in $S^2$ are configured along circle 2510A and circle 2510C. In this example, the increment of azimuth angle in $S^1(\Delta\phi^1=\phi_{j+1}^1-\phi_j^1)$, is equal to the increment of azimuth angle in $S^2(\Delta\phi^2=\phi_{j+1}^2-\phi_j^2)$: $\Delta\phi^1=\Delta\phi^2$. The azimuth angles in the two subsets are offset by the azimuth offset angle $\delta\phi^{2,1}=\phi_1^2-\phi_1^1$. In FIG. 25, $\phi^1=(10, 30, 50, \ldots, 350, 370)$deg, $\phi^2=(0, 20, 40, \ldots, 320, 340)$deg, and $\delta\phi^{2,1}=-10$ deg. In general, there can be more than two subsets of points.

Figure 26:
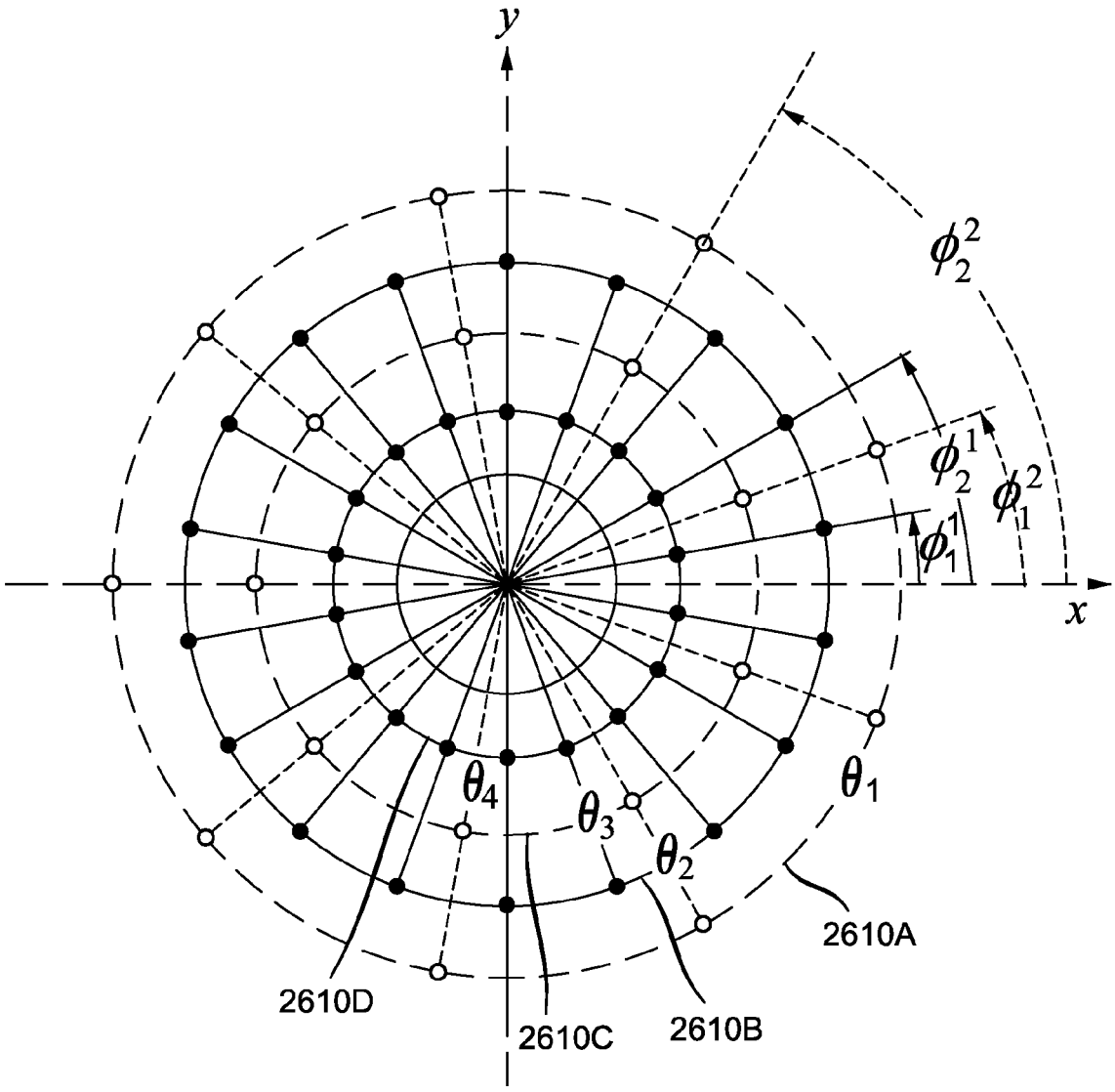
FIG. 26 shows a polar projection map of two subsets of points at which an array of conducting elements are located on a hemispherical convex ground plane, wherein the increment of azimuth angle in the first subset is not equal to the increment of azimuth angle in the second subset, and the azimuth offset angle is non-zero.

Refer to the polar projection map shown in FIG. 26. The set of points are configured along circles of constant meridian angle θ. Circle 2610A-circle 2610D correspond to meridian angles $\theta_1$-$\theta_4$, respectively. With respect to azimuth angle, the set of points are partitioned into two subsets, $S^1$ and $S^2$. The subset $S^1$, represented by the filled circles, have corresponding azimuth angles belonging to the set $\phi^1=(10, 30, 50, \ldots, 330, 350)$deg. The subset $S^2$, represented by the open circles, have corresponding azimuth angles belonging to the set $\phi^2=(20, 60, 100, \ldots, 300, 340)$deg. In this example, the increment of azimuth angle in $S^1$ is $\Delta\phi^1=20$ deg, the increment of azimuth angle in $S^2$ is $\Delta\phi^2=40$ deg, and the azimuth offset angle is $\delta\phi^{2,1}=10$ deg. In general, there can be more than two subsets of points, with different increments of azimuth angle and different azimuth offset angles.

Consider an array of conducting elements disposed on a convex ground plane, which has a hemispherical shape with radius $r_0$. The set of points on the surface of the convex ground plane is then specified by their angular coordinates: $P_{i,j}=P(\theta_i, \phi_j)$, where i and j are integers. As discussed above, the points lie on circles of constant meridian angle. The difference (increment) in meridian angles between two adjacent circles, i=I and i=I+1, is then $\Delta\theta_I=\theta_{I+1}-\theta_I$. In general, the difference in meridian angles between two adjacent circles is not necessarily constant and can vary as a function of meridian angle: $\Delta\theta_I=\Theta(\theta_I)$.

For a specific circle, i=I the difference (increment) in azimuth angles between two adjacent points, j=J and j=J+1, is $\Delta\phi_{I,J}=\phi_{I,J+1}-\phi_{I,J}$. To maintain azimuthal symmetry, the difference in azimuth angles between two adjacent points on the same circle is a constant: $\Delta\phi_{I,J}=\Delta\phi_I$. In general, however, the difference in azimuth angles between two adjacent points on the same circle is not necessarily the same for different circles and can vary as a function of meridian angle: $\Delta\phi_I=\Phi(\theta_I)$.

Let ρ be the surface density of points (number of points per unit area on the surface of the convex conducting plane); then ρ is a function of meridian angle: $\rho=\rho(\theta_I)=\rho\{\Theta(\theta_I),\Phi(\theta_I)\}$. The surface density increases as $\Delta\theta_I$ and $\Delta\phi_I$ decrease. In one embodiment, $\rho=\rho(\theta_I)$ decreases as $\theta_I$ increases. In another embodiment, $\rho=\rho(\theta_I)$ increases as $\theta_I$ increases. One specific example of the variation of surface density with meridian angle is the following: $\Delta\phi_I$=const is the same constant for all I (all circles), and the surface density is inversely proportional to the cosine of meridian angle: $\rho(\theta_I)\propto 1/\cos\theta_I$.

Figure 10:
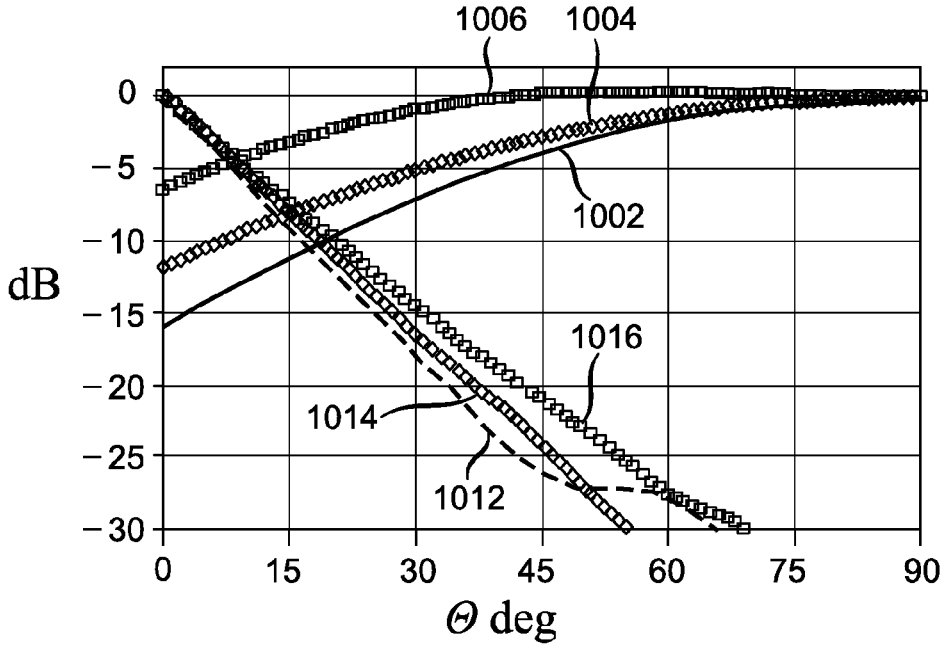
FIG. 10 shows plots of antenna directivity patterns and down/up ratios as a function of incident angle.

FIG. 10 shows plots of antenna directivity patterns and corresponding D/U ratios, as a function of angle θ (2-D approximation). Results for a flat high impedance ground plane and two examples of convex ground planes are compared. The flat ground plane models a choke ring. The convex ground plane models embodiments of the invention. Structures with dimensions $2r_0=D=2\lambda$ (close to practice) were chosen for analysis. Plot 1002, plot 1004, and plot 1006 plot the dependence of the antenna directivity pattern (in dB) for a flat ground plane, circular ground plane 1, and circular ground plane 2, respectively. Plot 1012, plot 1014, and plot 1016 plot the dependence of the D/U ratio (in dB) for a flat ground plane, circular ground plane 1, and circular ground plane 2, respectively. Circular ground plane 1 and circular ground plane 2 have different impedance distributions along the ground plane. Circular ground plane 1 has a uniform impedance distribution implemented by pins of constant height; and circular ground plane 1 has a non-uniform impedance distribution implemented by pins of varying height (see FIG. 14).

Note that, in the horizon direction (θ=0 deg), the circular ground plane 1 provides a 5 dB improvement in antenna directivity pattern without affecting the D/U ratio. Circular ground plane 2 provides a 10 dB improvement; however, the D/U ratio can become slightly worse. This degradation not too critical since the D/U ratio decreases in absolute value as a function of angle θ, as is seen for the angular region with $DU(\theta)\leqq -20$ dB.

APPENDIX A

Numerical Procedure for Calculating the Impedance of a Pin Structure

Consider an incident flat uniform vertically-polarized wave that falls on an infinite periodic pin array (see FIG. 5A) arranged on a metal plane:

$$\vec{E}_{inc}=U_{inc}(\vec{x}_0 k\sin(\theta)+\vec{z}_0 k\cos(\theta))e^{-ik(\cos(\theta)x-\sin(\theta)z)}. \tag{A1}$$

With the boundary condition that the tangential component of the field E becomes zero on a metal surface, the equation for the electric current in a pin $\vec{j}_e$ is the following:

$$\int_S \vec{j}_e^{*}\left(\vec{E}\left(\vec{j}_e\right)+\vec{E}_0\right)dS=0, \tag{A2}$$

where $\vec{E}_0$ is the electric field of the sum of the incident wave and the wave reflected from the flat ground plane, and S is the surface of the pin.

Equation (A2) is solved by the moments method with expansion of electric current according to the triangle basis with carrier 2ΔZ. It is assumed that azimuthal variations of pin current are absent; this assumption is true for small pin radius a<<λ. Then, $$\vec{j}_e(r,\phi,z)=\sum_\alpha I_\alpha\vec{\psi}_\alpha(r,\phi,z), \tag{A3}$$

where $$\psi_\alpha(r,\phi,z)=\frac{1}{2\pi a}\delta(r-a)\left(1-\frac{|z-z_\alpha|}{\Delta z}\right)\vec{z}_0. \tag{A4}$$

Then (A2) resolves itself into a linear equation system with unknown $I_\alpha$. Matrix elements for the linear equation system are mutual/cross resistances:

$$Z_{\alpha\beta} = -\int_S \vec{\psi}_\alpha^* \vec{E}(\psi_\beta) dS. \tag{A5}$$

Here, the electrical field of the pin is found by expansion in Floquet's spatial harmonics $\vec{e}_{nm}$ (as discussed in N. Amitay, V. Galindo, and C. P. Wu "Theory and Analysis of Phased Array Antennas," Wiley-Interscience, New York, 1972):

$$\vec{E}(\vec{\psi}_\beta) = \sum_{n,m} A_{nm}\vec{e}_{nm}. \tag{A6}$$

The coefficients $A_{mn}$ are defined by the Lorentz lemma (as discussed in Y. T. Lo, S. W. Lee "Antenna Handbook" v.1, Van Nostrand Reinhold, 1993).

Upon finding the coefficients $I_\alpha$, the complete field and, hence, the impedance can be calculated. In particular, at distances $T_x$ and $T_y$ on the order of 0.1λ, the current distribution over the pin is close to cosine; that is, the current in the pin is:

$$\vec{j}_e(r, \phi, z) \approx \frac{I}{2\pi a}\delta(r-a)\cos\left(\frac{\pi}{2L}z\right)\vec{z}_0. \tag{A7}$$

The amplitude I is then analytically determined; at θ=90°, expression (E11) follows.

APPENDIX B

Integral Equations and Antenna Directivity Pattern Calculations for Impedance Ground Planes Consider a ground plane with length L and with a reactive surface admittance Y(x) being excited by a source in the form of a magnetic current in the center of the ground plane:

$$\vec{j}_{ext}^{\,m} = U_0\delta(x)\vec{y}_0, \tag{B1}$$

where $j_{ext}^{\,m}$ is the surface magnetic current density, and $U_0$ is the amplitude in volts. The impedance boundary can be described by an equivalent magnetic current on an ideally-conducting ground plane:

$$\vec{j}^{\,m}(x) = -\vec{y}_0 E_x = \frac{\vec{H}(x)}{Y(x)}. \tag{B2}$$

The boundary conditions are then specified by the following:

$$H_y(j^m) + H_y(j_{ext}^{\,m}) = j_y^{\,m} Y(x). \tag{B3}$$

Consider field $H_y$ as an integral through a surface of the ground plane:

$$H_y(x) = \int_{-\frac{D}{2}}^{\frac{D}{2}} j_y^m(x')G(x, x')dx', \tag{B4}$$

and obtain equation (E13). This equation is solved by Galerkin's method. The current $\vec{j}^{\,m}(x)$ is expanded into a set of piecewise-constant functions:

$$\vec{j}^{\,m}(x) = \sum_\beta U_\beta \vec{\psi}_\beta(x), \tag{B5}$$

where $\vec{\psi}_\beta(x)$ is the basis function and $U_\beta$ is the unknown amplitude which can be found by solving a linear algebraic equation system.

The matrix elements of the system of linear algebraic equations are the cross-source admittances. These admittances are summed with the surface admittance in the diagonal elements. The admittances are calculated in approximation to an infinite ground plane. After the magnetic current distribution $\vec{j}^{\,m}$ has been calculated, the directivity pattern is computed with:

$$F(\theta) = \int_{-\frac{D}{2}}^{\frac{D}{2}} (j_y(x) + j_{y\,ext}(x))F_q(\theta, x)dx. \tag{B6}$$

Here the directivity pattern $F_q(x,\theta)$ for an elementary source arranged on a metal ground plane, with length L, is calculated in the Kirchhoff approximation (see, for example, U.S. Pat. No. 6,278,407).

Equation (E14) for a circular impedance surface can be obtained in a similar way. A magnetic current through a cylindrical surface is also taken with expansion in a piecewise-constant basis:

$$\vec{j}^{\,m}(\theta) = \sum_\beta U_\beta \vec{\psi}_\beta(\theta), \tag{B7}$$

where $$\vec{\psi}_\beta(x) = \frac{1}{r_0\Delta\theta}\vec{z}_0; \quad \theta \in \left(\theta_\beta - \frac{\Delta\theta}{2},\ \theta_\beta + \frac{\Delta\theta}{2}\right). \tag{B8}$$

Here the field is a sum of cylindrical harmonics:

$$G(\theta, \theta') = \sum_n C_n H_n^{(2)}(kr_0)e^{-in(\theta-\theta')}. \tag{B9}$$

The expressions for the matrix elements of the system of linear algebraic equations and for the point (elementary) source pattern $F_q(\theta)$ are then:

$$Y_{\alpha\beta} = \frac{-i}{2W\pi}\frac{1}{r_0}\sum_n \frac{H_n^{(2)}(kr_0)}{H_n^{(2)\prime}(kr_0)}\left(\frac{\sin\left(\frac{n\Delta\phi}{2}\right)}{\frac{n\Delta\phi}{2}}\right)^2 e^{in(\theta_\beta-\theta_\alpha)}, + \delta_{\alpha\beta}\int_0^{2\pi}\psi_\alpha^2 Y(\theta)ad\theta \tag{B10}$$

and $$F_q(\theta) = \sum_n \frac{1}{H_n^{(2)\prime}(kr_0)}e^{i\frac{\pi}{2}n}e^{in(\theta_\beta-\theta_\alpha)}. \tag{B11}$$

The antenna directivity pattern is then calculated as:

$$F(\theta) = \int_0^{2\pi} (j_z(\theta') + j_{z\,ext}(\theta'))F_q(\theta, \theta')d\theta'. \tag{B12}$$

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. A ground plane comprising:
a convex conducting surface; and
an array of conducting elements disposed on a plurality of circles on at least a portion of the convex conducting surface, wherein:
one of the plurality of circles has a specific corresponding meridian angle which differs from a meridian angle of one other of the plurality of circles; and
the lengths of conducting elements increase as the corresponding meridian angle increases.

2. The ground plane of claim 1, wherein each conducting element in the array of conducting elements comprises an elongated body structure having a transverse dimension and a length, wherein the ratio of the transverse dimension to the length is approximately 0.01 to 0.2.

3. The ground plane of claim 2, wherein a cross-section of the elongated body structure comprises one of:
an ellipse; and
a triangle.

4. The ground plane of claim 2, wherein each conducting element in the array of conducting elements further comprises a tip structure.

5. The ground plane of claim 4, wherein the tip structure comprises one of:
a portion of a sphere;
a sphere;
a portion of an ellipsoid;
an ellipsoid;
a cylinder;
a disc;
a rectangular prism;
a cone;
a truncated cone;
an elbow; and
a tee.

6. The ground plane of claim 1, wherein
adjacent conducting elements disposed on a specific circle are separated by a specific increment of azimuth angle.

7. The ground plane of claim 6, wherein the specific increments of azimuth angle for at least two different specific circles are different.

8. The ground plane of claim 6, wherein the specific increments of azimuth angle for any two different specific circles are different.

9. The ground plane of claim 8, wherein the specific increment of azimuth angle for a specific circle is based at least in part on the specific corresponding meridian angle of the specific circle.

10. The ground plane of claim 1, wherein the lengths of the conducting elements disposed on at least two different specific circles are different.

11. The ground plane of claim 1, wherein the lengths of the conducting elements disposed on any two different specific circles are different.

12. The ground plane of claim 1, wherein the array of conducting elements is disposed on:
a first circle having a corresponding first meridian angle, wherein each conducting element disposed on the first circle has a corresponding azimuth angle selected from a first set of azimuth angles, wherein adjacent azimuth angles in the first set of azimuth angles are separated by a first increment of azimuth angle; and
a second circle having a corresponding second meridian angle, wherein each conducting element disposed on the second circle has a corresponding azimuth angle selected from a second set of azimuth angles, wherein adjacent azimuth angles in the second set of azimuth angles are separated by a second increment of azimuth angle.

13. The ground plane of claim 12, wherein the first increment of azimuth angle is equal to the second increment of azimuth angle.

14. The ground plane of claim 13, wherein the first set of azimuth angles and the second set of azimuth angles are offset by an azimuth offset angle.

15. The ground plane of claim 12, wherein the first increment of azimuth angle is not equal to the second increment of azimuth angle.

16. The ground plane of claim 1, wherein the convex conducting surface comprises a portion of a sphere and wherein the diameter of the sphere is approximately (0.5-3)λ, wherein λ is a wavelength of a global navigation satellite system signal.

17. The ground plane of claim 1, wherein the convex conducting surface comprises a sphere and wherein the diameter of the sphere is approximately (0.5-3)λ, wherein λ is a wavelength of a global navigation satellite system signal.

18. The ground plane of claim 1, wherein the convex conducting surface is represented by a function r(θ) in a spherical coordinate system with an origin O, wherein the function is $$r(\theta)=r_0-r_1(\theta);$$

r(θ) is a radius from the origin O to a point on the convex conducting surface with meridian angle θ;
$r_0$ is a constant with a value ranging from approximately (0.5-1.5)λ, wherein λ is a wavelength of a global navigation satellite system signal; and
$r_1(\theta)$ is a user-defined function with a magnitude $|r_1(\theta)| \leqq 0.25\lambda$.

19. An antenna system comprising:
an antenna;
a ground plane comprising:
a convex conducting surface; and
an array of conducting elements disposed on at least a portion of the convex conducting surface, and
a system component comprising at least one of:
a navigation receiver;
a low noise amplifier;
a signal processor;
a wireless modem; and
a sensor,
wherein the system component is located within the convex conducting surface.

20. The antenna system of claim 19, further comprising:
a dome covering the antenna.

21. The antenna system of claim 19, further comprising:
a dome covering the antenna and the ground plane.

22. A ground plane comprising:

a convex conducting surface; and an array of conducting elements disposed on a plurality of circles on at least a portion of the convex conducting surface, wherein:

adjacent conducting elements disposed on a specific circle are separated by a specific increment of azimuth angle, the specific increments of azimuth angle are the same for all circles in the plurality of circles, a surface density of the array of conducting elements disposed on the specific circle is based at least in part on a specific corresponding meridian angle of a specific circle and is inversely proportional to the cosine of the specific corresponding meridian angle.

* * * * *